US010876796B2

(12) United States Patent
Ciaffarafa et al.

(10) Patent No.: US 10,876,796 B2
(45) Date of Patent: Dec. 29, 2020

(54) HEAT EXCHANGER

(71) Applicant: DENSO Marston Ltd., West Yorkshire (GB)

(72) Inventors: Mario Ciaffarafa, West Yorkshire (GB); Martin Timmins, West Yorkshire (GB)

(73) Assignee: DENSO Marston Ltd., West Yoskshire (GB)

( * ) Notice: Subject to any disclaimer, the term of this patent is extended or adjusted under 35 U.S.C. 154(b) by 0 days.

(21) Appl. No.: 15/825,652

(22) Filed: Nov. 29, 2017

(65) Prior Publication Data

US 2018/0156547 A1 Jun. 7, 2018

(51) Int. Cl.

| | |
|---|---|
| ***F28D 9/00*** | (2006.01) |
| ***F28F 3/08*** | (2006.01) |
| ***F28F 3/02*** | (2006.01) |
| ***F28F 9/02*** | (2006.01) |
| *F28F 13/06* | (2006.01) |

(52) U.S. Cl.

CPC ..... *F28D 9/0062* (2013.01); *F28D 9/0012* (2013.01); *F28D 9/0068* (2013.01); *F28D 9/0075* (2013.01); *F28F 3/027* (2013.01); *F28F 3/08* (2013.01); *F28F 9/02* (2013.01); *F28F 13/06* (2013.01); *F28F 2280/00* (2013.01)

(58) Field of Classification Search

CPC ..... F28D 9/062; F28D 9/068; F28D 9/075; F28D 9/0062; F28D 9/0068; F28D 9/0075; F28F 3/08

USPC ..... 165/166, 167

See application file for complete search history.

(56) References Cited

U.S. PATENT DOCUMENTS

| | | | | |
|---|---|---|---|---|
| 1,409,967 | A * | 3/1922 | Prat | F28D 9/0062 165/166 |
| 2,595,308 | A * | 5/1952 | Simpelaar | F28D 9/0062 165/165 |
| 2,606,007 | A * | 8/1952 | Simpelaar | F28D 9/0062 165/166 |
| 2,782,010 | A * | 2/1957 | Simpelaar | F28D 9/0075 165/167 |
| 3,017,161 | A * | 1/1962 | Slaasted | F28D 1/0375 165/166 |
| 4,301,863 | A * | 11/1981 | Bizzarro | F28D 9/0062 165/166 |
| 4,561,494 | A | 12/1985 | Frost | |
| 5,101,894 | A | 4/1992 | Hendricks | |
| 2010/0186924 | A1 | 7/2010 | Hiyama | |
| 2011/0209858 | A1 | 9/2011 | Konno | |
| 2014/0054022 | A1* | 2/2014 | Mitsuhashi | B23P 15/26 165/185 |
| 2015/0345876 | A1* | 12/2015 | Togo | F28F 9/02 165/157 |

FOREIGN PATENT DOCUMENTS

| | | | | |
|---|---|---|---|---|
| EP | 0529329 A2 * | 3/1993 | | B01J 8/0207 |
| EP | 0685699 B1 * | 7/1998 | | F28D 9/0062 |
| GB | 1287377 A | 8/1972 | | |

(Continued)

*Primary Examiner* — Eric S Ruppert

(57) ABSTRACT

A heat exchange spacer is for assembly with a heat exchange core. The heat exchange spacer has a unitary body including a first elongate portion and a second elongate portion. The first elongate portion and the second elongate portion define an angle therebetween.

11 Claims, 19 Drawing Sheets

(56) References Cited

FOREIGN PATENT DOCUMENTS

| | | | | | |
|---|---|---|---|---|---|
| JP | H04-327793 | A | | 11/1992 | |
| JP | H06-74675 | A | | 3/1994 | |
| JP | H09-318293 | A | | 12/1997 | |
| WO | WO-2015146678 | A1 | * | 10/2015 | ..... F28D 9/0062 |

* cited by examiner

HEAT EXCHANGER

CROSS REFERENCE TO RELATED APPLICATION

This application is based on United Kingdom Patent Application No. 1620749.0 filed on Dec. 6, 2016, the disclosure of which is incorporated herein by reference.

TECHNICAL FIELD

The present disclosure relates to a heat exchanger. The present disclosure further relates to a method of assembling a heat exchanger.

BACKGROUND

Known heat exchangers, for example bar and plate type heat exchangers, include fluid conduits that are assembled from an array of plates, spacer bars and fins. Such heat exchangers have hot fluid and cold fluid in adjacent layers that are separated by the plates. The plates and bars are normally arranged such that a series of openings for the hot fluid are provided on one side of the heat exchanger and a series of openings for the cold fluid are provided on the opposite side of the heat exchanger. Separate tanks are fixed over each of the openings to provide an inlet and an outlet for each of the hot fluid and the cold fluid.

The assembly of known heat exchangers is complex, at least in part because the spacer bars are assembled in a complexity of discrete linear lengths. Furthermore, each spacer bar within the heat exchanger is sealed in position by a series of welds to prevent leaks within the heat exchanger. The number of discrete spacer bars and the number of welds required in known heat exchangers renders known heat exchangers to be complex to manufacture and therefore vulnerable to leaking.

It is currently only possible to manufacture heat exchangers in non-complex shapes, for example cuboid, which restricts where the inlets and outlets for connection to fluid supplies can be connected.

SUMMARY

It is an object of the present disclosure to produce a new heat exchanger. It is an object of the present disclosure to produce a new method of assembling the heat exchanger.

According to an aspect of the present disclosure, a heat exchanger comprises a heat exchange core for a plate heat exchanger, the heat exchange core including a first plate, a second plate and a heat exchange layer, the heat exchange layer being positioned between the first plate and the second plate. The heat exchange layer includes a heat exchange fin that defines at least one passageway for a fluid. The heat exchange layer further includes at least one heat exchange spacer. The at least one heat exchange spacer has a unitary body including a first elongate portion and a second elongate portion. The first elongate portion and the second elongate portion define an angle therebetween. At least one opening is defined between the ends of one unitary body or the ends of two unitary bodies, or is defined by at least one joggle in the at least one unitary body that extends outward. The heat exchange layer further includes at least one tank with a tank opening such that the tank opening is in fluid communication with the at least one opening.

According to another aspect of the present disclosure, a method of assembling a heat exchanger comprises the steps of (a) providing a base plate. The method further comprises (b) mounting at least one heat exchange spacer on the base plate. The method further comprises (c) mounting a first heat exchange fin defining at least one first fluid passageway on the at least one heat exchange spacer of step (b). The method further comprises (d) mounting a first inner plate on the first heat exchange fin. The method further comprises (e) mounting at least one heat exchange spacer on the inner plate. The method further comprises (f) mounting a second heat exchange fin defining at least one second fluid passageway on the at least one heat exchange spacer of step (e). The method further comprises (g) mounting a second inner plate on the second heat exchange fin. The method further comprises (h) mounting at least one heat exchange spacer on the base plate. The method further comprises (i) mounting a further first heat exchange fin defining at least one first fluid passageway on the at least one heat exchange spacer of step (h). The method further comprises (j) mounting an upper plate on the further first heat exchange fin. The mounting of at least one heat exchange spacer includes the steps of: (k) providing at least one unitary body. The mounting further includes (l) shaping the unitary body to provide a first elongate portion and a second elongate portion, the first elongate portion and the second elongate portion defining an angle therebetween. The mounting further includes (m) finishing the shaped unitary body, wherein at least one opening is defined between ends of one unitary body or ends of two unitary bodies or is defined by at least one joggle in the at least one unitary body that extends outwardly. The mounting further includes (n) mounting at least one tank with a tank opening such that the tank opening is in fluid communication with the at least one opening.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiment

Figure 1:
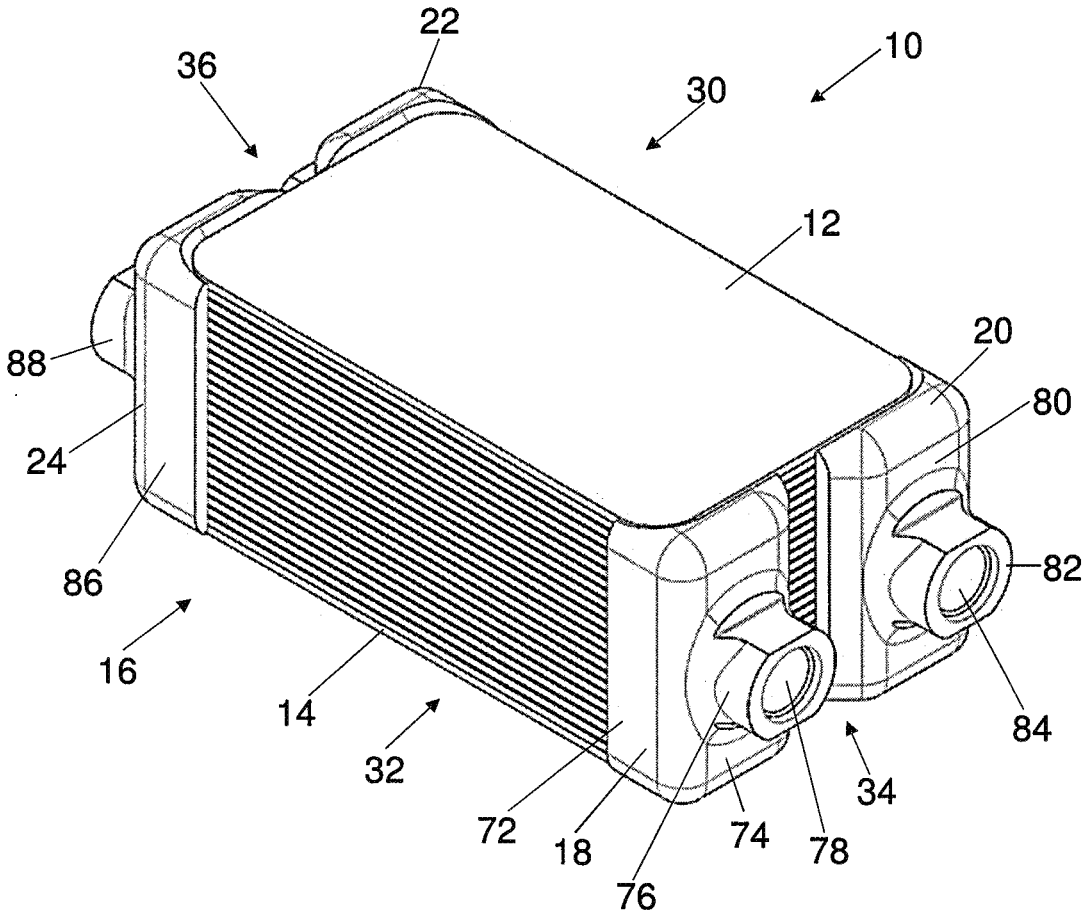
FIG. 1 is an isometric view of a heat exchanger.
Figure 2:
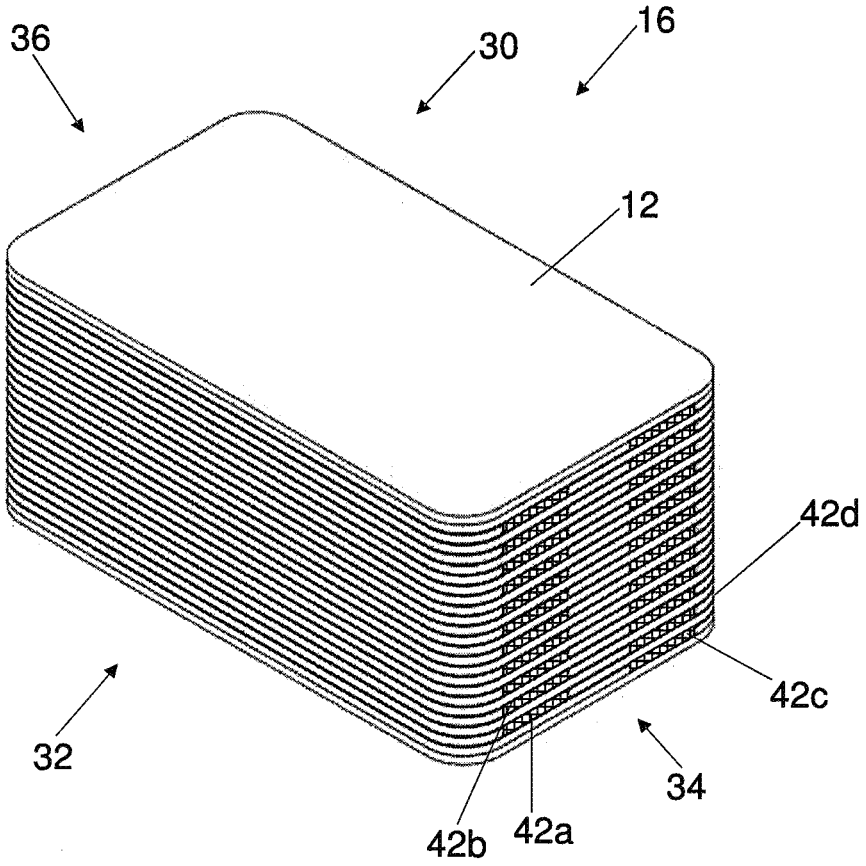
FIG. 2 is an isometric view of the heat exchange core of the heat exchanger of FIG. 1.

First and second embodiments of the present disclosure will now be described with particular reference to FIGS. 1 to 8 and 25.

Referring now to FIGS. 1 to 3 and 5, there is a heat exchanger 10. The heat exchanger 10 is a plate and bar heat exchanger having a lower plate (first plate, base plate) 14, an upper plate (second plate) 12, a heat exchange core 16 and four tanks 18, 20, 22, 24. The heat exchanger 10 also has mounting feet 26, 28. The heat exchanger 10 is generally cuboid and has a first side 30, a second side 32, a first end 34 and a second end 36. The heat exchange core 16 has a plurality of plates 38*a*, 38*b*, 38*c*, 38*d*, a plurality of heat exchange spacers 40*a*, 40*b*, 40*c*, 40*d*, 40*e*, 40*f*, 40*g*, 40*h* and a plurality of heat exchange fins 42*a*, 42*b*, 42*c*, 42*d*.

Figure 7:
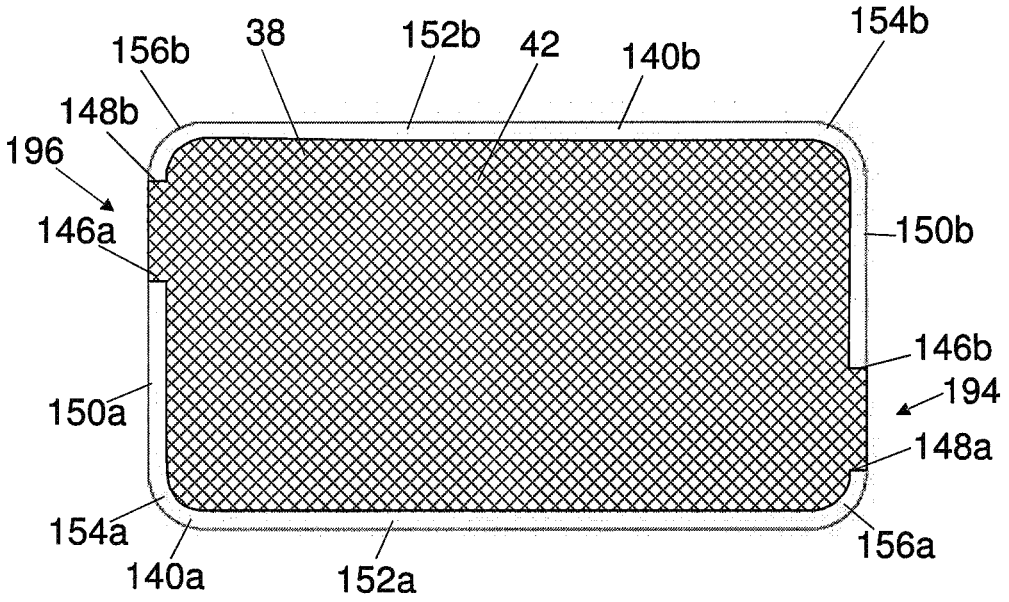
FIG. 7 is a plan view of a plate and two heat exchange spacers according to the second embodiment of the present disclosure.
Figure 8:
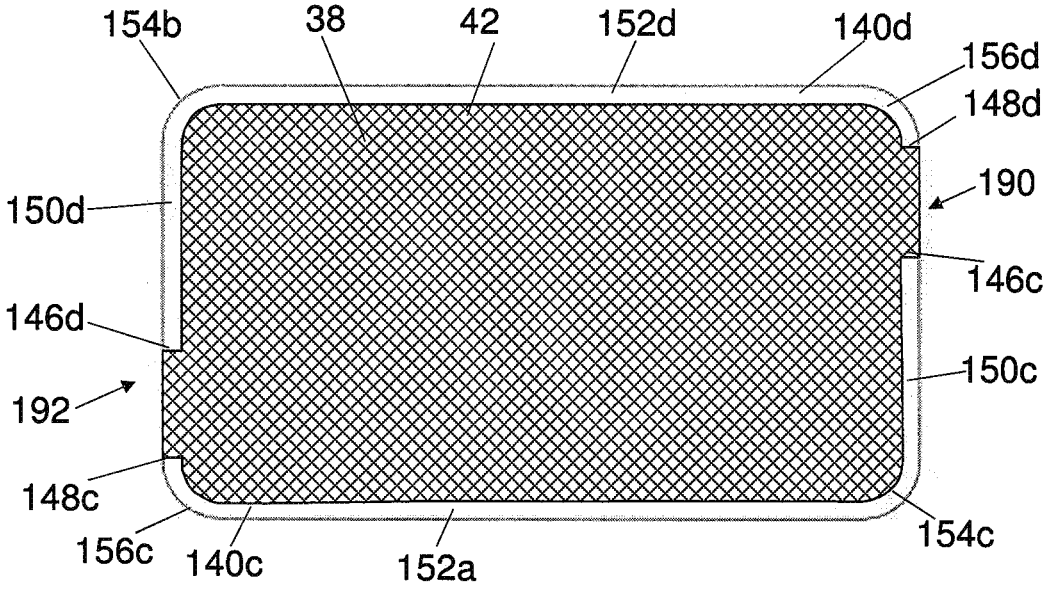
FIG. 8 is an alternative plan view of a plate and two heat exchange spacers according to the second embodiment of the present disclosure.
Figure 9:
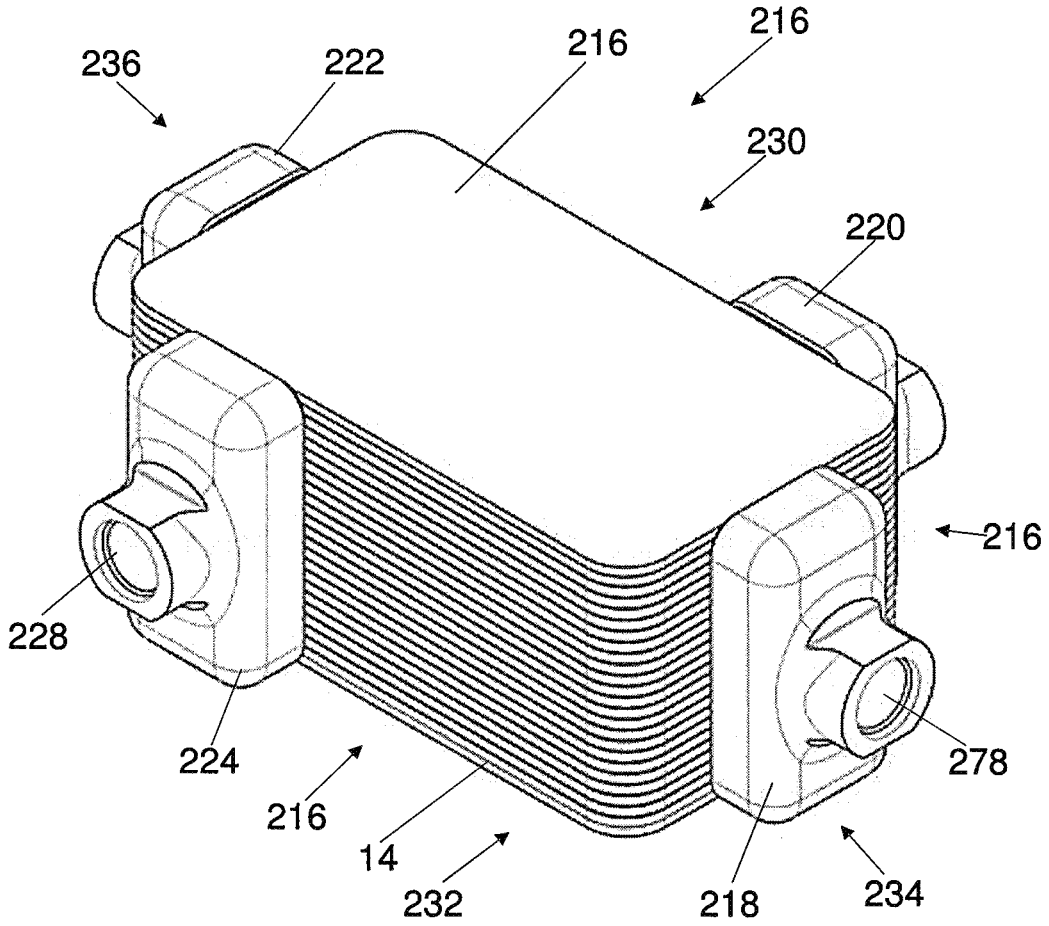
FIG. 9 is an isometric view of an alternative heat exchanger.
Figure 10:
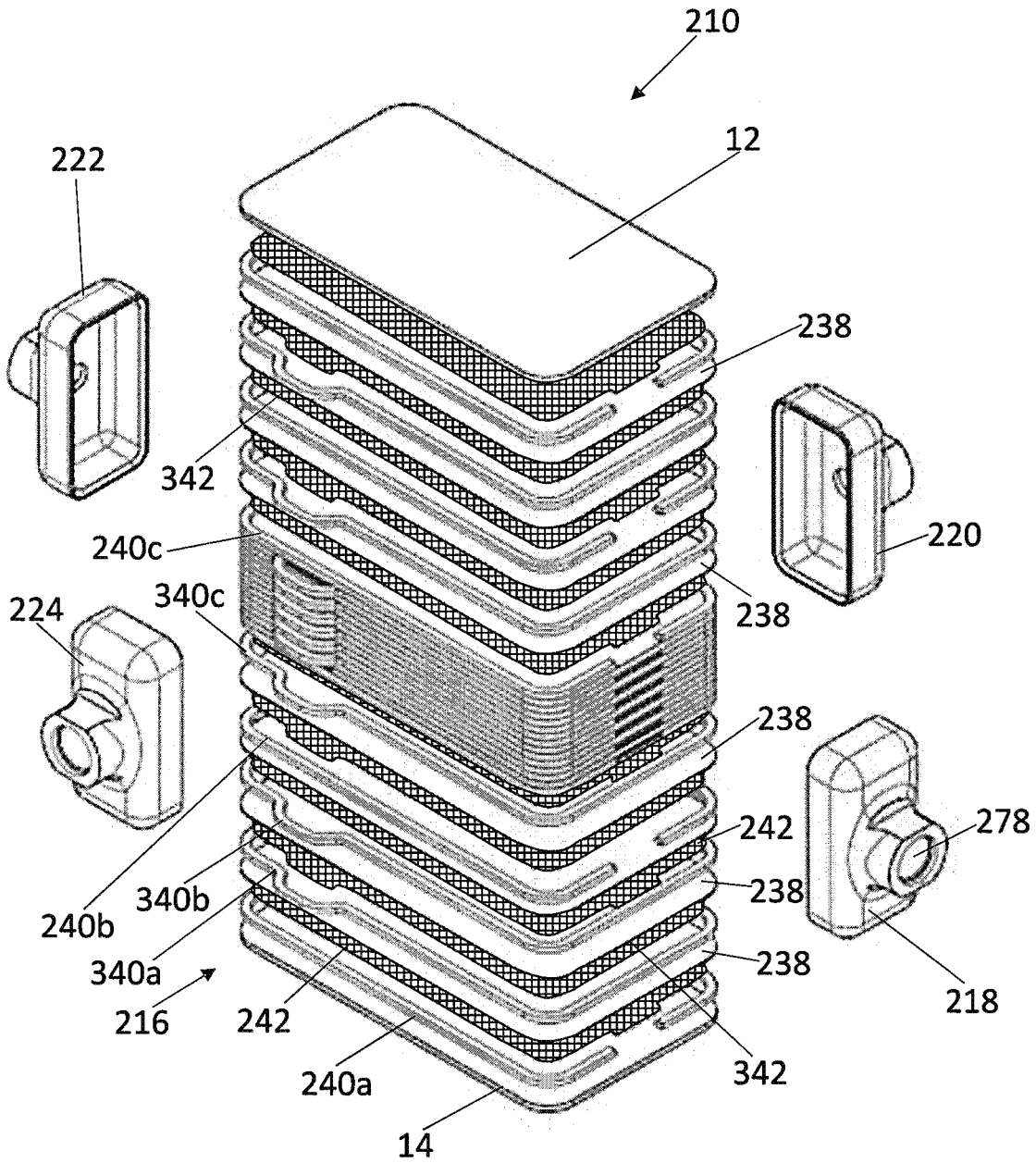
FIG. 10 is an exploded view of the heat exchanger of FIG. 9 including a plurality of heat exchange spacers according to third and fourth embodiments of the present disclosure.
Figure 25:
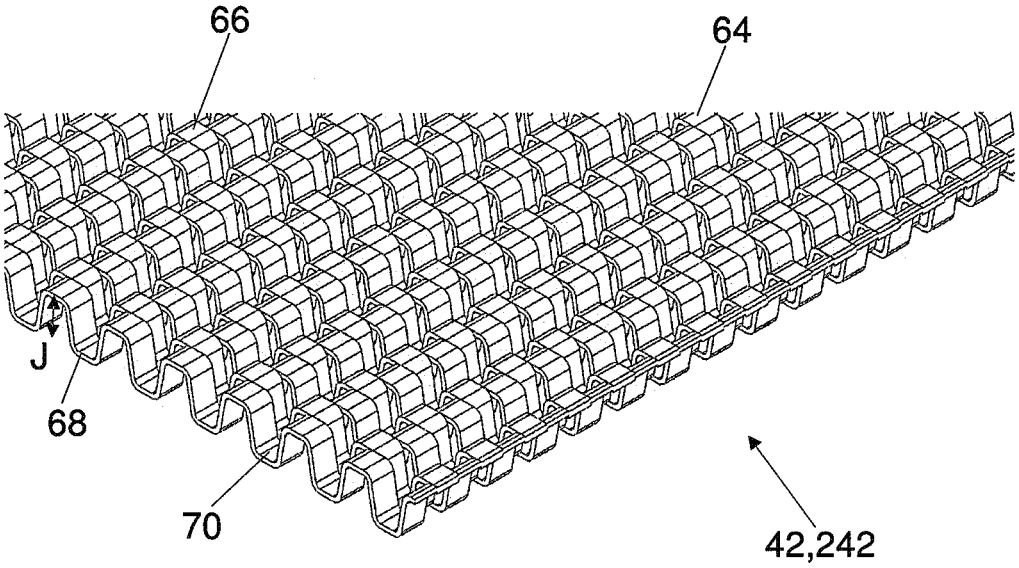
FIG. 25 is a partial isometric view of a heat exchange fin for use in conjunction with the heat exchangers of FIGS. 1 and 9.

With reference to FIGS. 7, 8 and 25, each of the heat exchange fins 42 includes an undulating surface 64 having a plurality of peaks 66 and troughs 68 that define at least one passageway 70 for the passage of a fluid (not shown). The distance between each peak 66 and its corresponding trough 68 defines the height J of heat exchange fin 42.

Figure 4A:
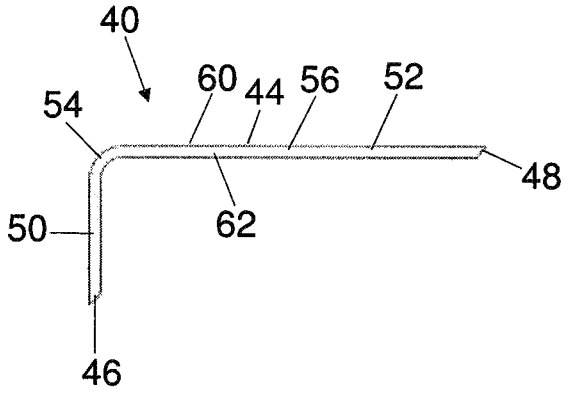
FIG. 4A is a plan view of a heat exchange spacer according to the first embodiment of the present disclosure.
Figure 4B:
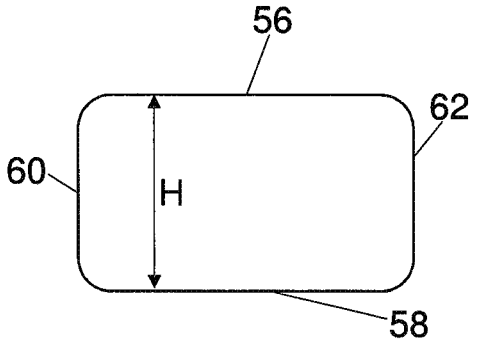
FIG. 4B is a cross section view of the heat exchange spacer of FIG. 4A.
Figure 5:
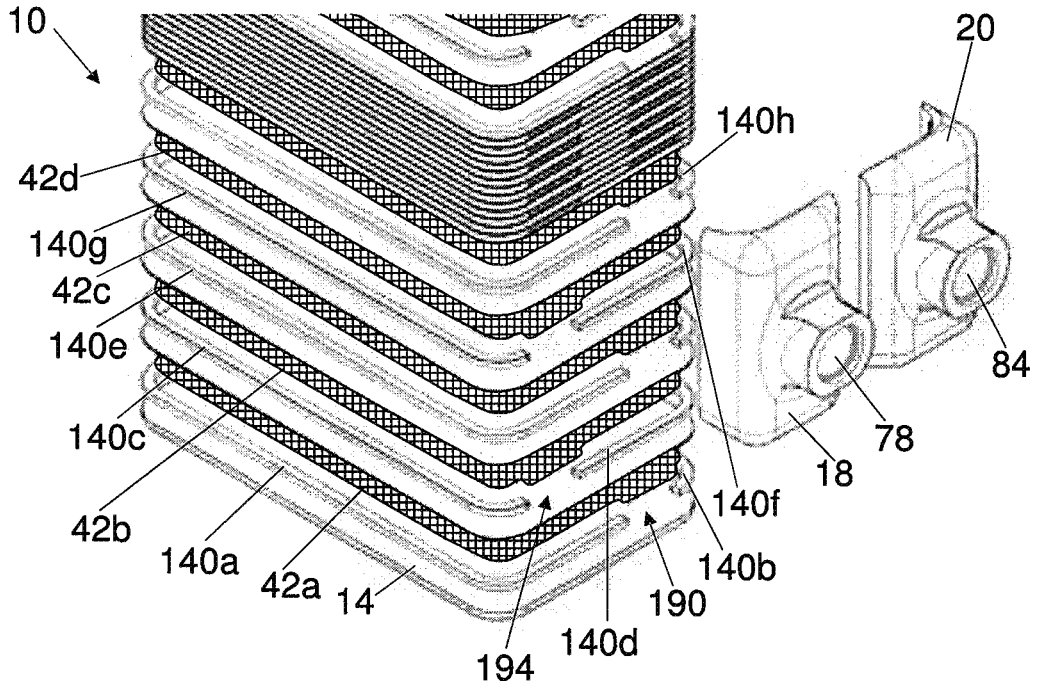
FIG. 5 is a partial exploded view of a heat exchanger having a heat exchange core that has a plurality of heat exchange spacers according to a second embodiment of the present disclosure.

As shown in FIGS. 4A and 4B, each of the heat exchange spacers 40 according to the first embodiment of the present disclosure has a unitary body 44. The unitary body 44 has a first end 46 and a second end 48. The unitary body 44 further has a first elongate portion 50, a second elongate portion 52 and an arcuate portion or bend 54 between the first elongate portion 50 and the second elongate portion 52. Each of the heat exchange spacers 40 has a generally rectangular cross section, with an upper surface 56, a lower surface 58 and a first side wall 60 and a second side wall 62. Each of the heat exchange spacers 40 has a length defined by the distance between the first end 46 and the second end 48 and a height H defined by the distance between the upper surface 56 and the lower surface 58. The height H of each of the heat exchange spacers 40 is substantially constant along the length of each of the heat exchange spacers 40. The height H of each of the heat exchange spacers 40 is substantially the same as the height J of each of the heat exchange fins 42. This reduces the risk of leaks from the heat exchanger 10 once assembled.

With reference to FIG. 1, the first tank 18 has a side wall 72 and an end wall 74. The end wall 74 has a connector 76 that includes an opening (tank opening) 78. In the same way, the second tank 20 has a side wall (not shown) and an end wall 80. The end wall 80 has a connector 82 that includes an opening (tank opening) 84. The third tank 22 also has a side wall (not shown) and an end wall (not shown). The end wall of the third tank 22 has a connector (not shown) that includes an opening (not shown). The fourth tank 24 also has a side wall 86 and an end wall (not shown). The end wall of the fourth tank 24 has a connector 88 that includes an opening (not shown).

Figure 3:
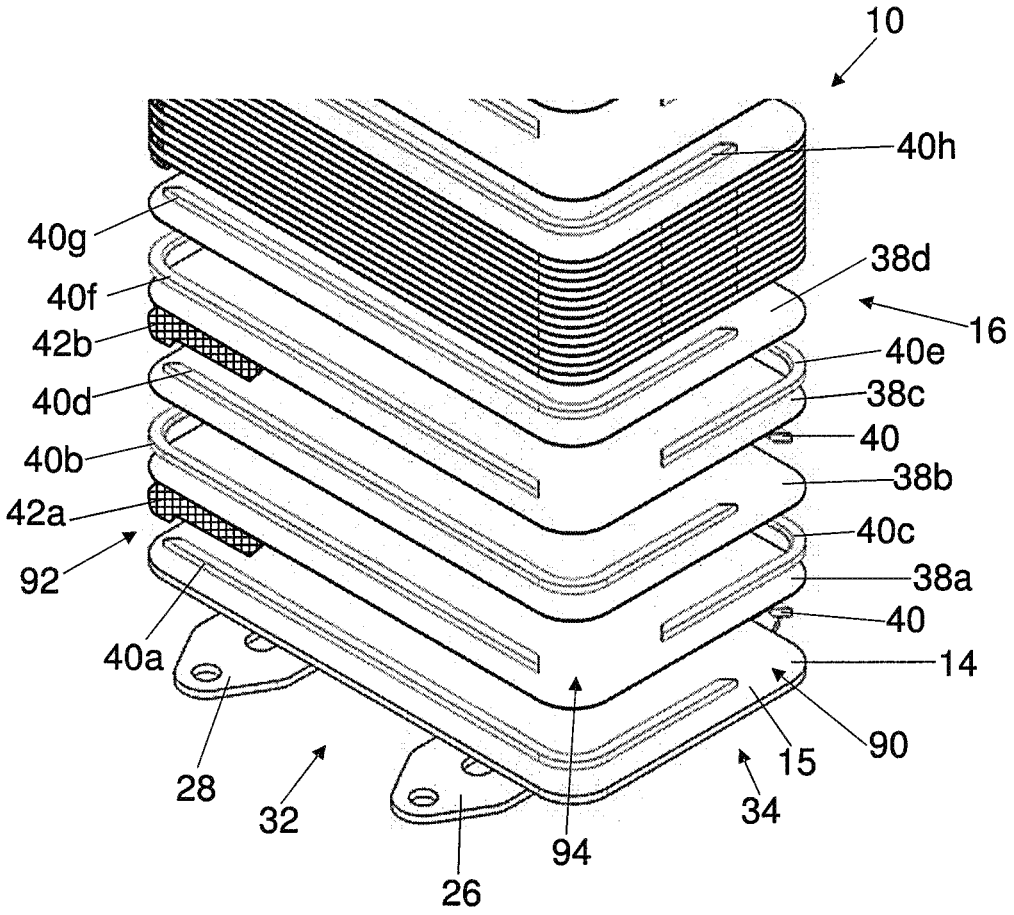
FIG. 3 is a partial exploded view of a heat exchanger having a heat exchange core that has a plurality of heat exchange spacers according to a first embodiment of the present disclosure, also including mounting feet.

Assembly of the heat exchanger 10 will now be described with particular reference to FIG. 3.

The heat exchange spacers 40 are formed from aluminium or an aluminium alloy, or any other material that is suitable for brazing, for example stainless steel, by rolling from a straight section, pressing from a flat plate or by extrusion. The heat exchange spacers 40 are bent into the shape shown in FIG. 4A and optionally planished in order to ensure that the height H of each heat exchange spacer 40 is constant along the length of the heat exchange spacer 40 and the heat exchange spacer 40 is sufficiently flat to facilitate heat exchanger assembly. The mounting feet 26, 28 are attached to a lower surface (not shown) of the lower plate 14.

The heat exchange core 16 is assembled as follows:

A first heat exchange layer is assembled by mounting a first heat exchange spacer 40*a* on an upper surface 15 of the lower plate 14 such that the lower surface 58 of the heat exchange spacer 40*a* is adjacent to the upper surface 15 of the lower plate 14. The first heat exchange spacer 40*a* is positioned on the lower plate 14 such that the first side wall 60 of the unitary body 44 at the first elongate portion 50 is adjacent to the edge of the lower plate 14 at the first end 34 of the heat exchanger 10 and the first side wall 60 of the unitary body 44 at the second elongate portion 52 is adjacent to the edge of the lower plate 14 at the second side 32 of the heat exchanger 10.

In a similar way, a further heat exchange spacer 40 is mounted on the upper surface 15 of the lower plate 14 such that the lower surface 58 of the heat exchanger spacer 40 is adjacent to the upper surface 15 of the lower plate 14. The further heat exchange spacer 40 is positioned on the lower plate 14 such that the first side wall 60 of the unitary body 44 at the first elongate portion 50 is adjacent to the edge of the lower plate 14 at the second end 36 of the heat exchanger 10 and the first side wall 60 of the unitary body 44 at the second elongate portion 52 is adjacent to the edge of the lower plate 14 at the first side 30 of the heat exchanger 10.

In this way a first opening 90 is defined between the first end 46 of the first heat exchange spacer 40*a* and the second end 48 of the further heat exchange spacer 40 and a second opening 92 is defined between the first end 46 of the further heat exchange spacer 40 and the second end 48 of the first heat exchange spacer 40*a*.

A first heat exchange fin 42*a* is mounted on the upper surfaces 15 of the lower plate 14 and between each of the first heat exchange spacer 40*a* and the further heat exchange spacer 40. A first heat exchange plate 38*a* is mounted on the first heat exchange fin 42*a*.

A second heat exchange layer is assembled by mounting a third heat exchange spacer 40*b* on the first heat exchange plate 38*a* such that the first side wall 60 of the unitary body 44 at the first elongate portion 50 is adjacent to the edge of the first heat exchange plate 38*a* at the second end 36 of the heat exchanger 10 and the first side wall 60 of the unitary body 44 at the second elongate portion 52 is adjacent to the edge of the first heat exchange plate 38*a* at the second side 32 of the heat exchanger 10.

In a similar way, a fourth heat exchange spacer 40*c* is positioned on the first heat exchange plate 38*a* such that the first side wall 60 of the unitary body 44 at the first elongate portion 50 is adjacent to the edge of the first heat exchange plate 38*a* at the first end 34 of the heat exchanger 10 and the first side wall 60 of the unitary body 44 at the second elongate portion 52 is adjacent to the edge of the first heat exchange plate 38*a* at the first side 30 of the heat exchanger 10.

In this way a third opening 94 is defined between the second end 48 of the third heat exchange spacer 40*b* and the first end 46 of the fourth heat exchange spacer 40*c* and a fourth opening (not shown) is defined between the second end 48 of the fourth heat exchange spacer 40*c* and the first end 46 of the third heat exchange spacer 40*b*.

A further heat exchange fin 42 is mounted on the heat exchange plate 38*a* and between each of the third heat exchange spacer 40*b* and the fourth heat exchange spacer 40*c*. A further heat exchange plate 38*b* is mounted on the further heat exchange fin 42. Additional first and second heat exchange layers are similarly assembled and mounted in alternating layers to form the heat exchange core 16.

In the final heat exchange layer, the heat exchange plate 38 is replaced by an upper plate 12. Each of the heat exchange spacers 40 are welded or brazed to the corresponding heat exchange plate 38 and heat exchange fin 42. The assembly of the heat exchanger 10 is less complex and the risk of leaks is reduced compared to traditional heat exchangers.

The first tank 18 is welded to the heat exchanger 10 such that the side wall 72 is mounted to the heat exchange core 16 at the second side 32 of the heat exchanger 10 and the end wall 74 is mounted to the heat exchange core 16 at the first end 34 of the heat exchanger 10. In this way, the opening 78 is in fluid communication with the openings 94 in each of the second heat exchange layers.

The second tank 20 is similarly welded to the heat exchanger 10 such that the side wall (not shown) is mounted to the heat exchange core 16 at the first side 30 of the heat exchanger 10 and the end wall 80 is mounted to the heat exchange core 16 at the first end 34 of the heat exchanger 10. In this way, the opening 84 is in fluid communication with the openings 90 in each of the first heat exchange layers.

The third tank 22 is similarly welded to the heat exchanger 10 such that the side wall (not shown) is mounted to the heat exchange core 16 at the first side 30 of the heat exchanger 10 and the end wall (not shown) is mounted to the heat exchange core 16 at the second end 36 of the heat exchanger 10. In this way, the opening (not shown) of the third tank 22 is in fluid communication with the fourth openings (not shown) in each of the second heat exchange layers.

The fourth tank 24 is similarly welded to the heat exchanger 10 such that the side wall 86 is mounted to the heat exchange core 16 at the second side 32 of the heat exchanger 10 and the end wall (not shown) is mounted to the heat exchange core 16 at the second end 36 of the heat exchanger 10. In this way, the opening (not shown) of the fourth tank 24 is in fluid communication with the openings 92 in each of the first heat exchange layers.

The first tank 18 is connected to a primary fluid source and the third tank 22 is connected to an outlet. The fourth tank 24 is connected to a secondary fluid source and the second tank 20 is connected to an outlet. In this way, the primary fluid is passed through the heat exchanger 10 from the openings 94 in the second heat exchange layers and the passageways 70 in the heat exchange fins 42 of the second heat exchange layers to the fourth openings (not shown) in the second heat exchange layers.

The secondary fluid is passed through the heat exchanger 10 in the opposite direction to the hot fluid from the openings 92 in the first heat exchange layers and the passageways 70 in the heat exchange fins 42 of the first heat exchange layers to the openings 90 in the first heat exchange layers.

The primary and secondary fluids can be any heat transfer fluid such as oil or water or refrigerant or air. The temperature of the primary fluid may be greater than the temperature of the secondary fluid. By passing the secondary fluid through the heat exchanger 10, the temperature of the primary fluid is reduced.

A plurality of heat exchange spacers 140*a*, 140*b*, 140*c*, 140*d*, 140*e*, 140*f*, 140*g*, 140*h* according to a second embodiment of the present disclosure are shown in FIGS. 5 to 8.

Figure 6:
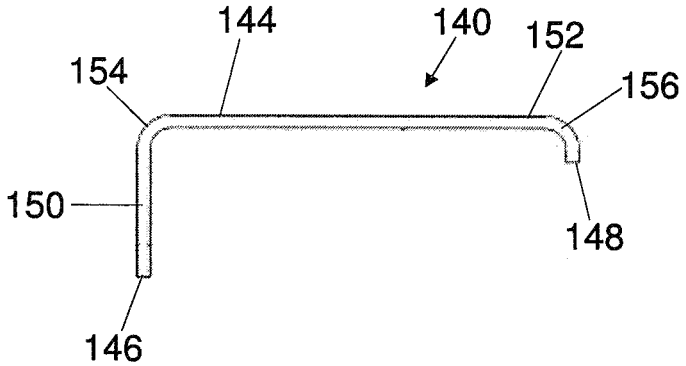
FIG. 6 is a plan view of a heat exchange spacer according to the second embodiment of the present disclosure.

As shown in FIG. 6, each of the heat exchange spacers 140 has a unitary body 144. The unitary body 144 has a first end 146 and a second end 148, a first elongate portion 150 and a second elongate portion 152. The unitary body 144 has a first arcuate portion or bend 154 between the first elongate portion 150 and the second elongate portion 152 and a second arcuate portion or bend 156 between the second elongate portion 152 and the second end 148. Each of the heat exchange spacers 140 has a generally rectangular cross section as shown in FIG. 4B in relation to the first embodiment of the present disclosure, with an upper surface 56, a lower surface 58 and a first side wall 60 and a second side wall 62. Each of the heat exchange spacers 140 has a length defined by the distance between the first end 146 and the second end 148 and a height H defined by the distance between the upper surface 56 and the lower surface 58. The height H of each of the heat exchange spacers 140 is substantially constant along the length of each of the heat exchange spacers 140.

Assembly of the heat exchange spacers 140 into first and second heat exchange layers for use in the heat exchanger 10 will now be described. Referring now to FIG. 7, a first heat exchange spacer 140*a* is mounted on an upper surface of the heat exchange plate 38 such that the lower surface 58 of the heat exchange spacer 140*a* is adjacent to the upper surface of the heat exchange plate 38. The first heat exchange spacer 140*a* is positioned on the heat exchange plate 38 such that the first side wall 60 of the unitary body 144 at the first elongate portion 150*a* is adjacent to the edge of the heat exchange plate 38 at the second end 36 of the heat exchanger 10 and the first side wall 60 of the unitary body 144 at the second elongate portion 152*a* is adjacent to the edge of the heat exchange plate 38 at the second side 32 of the heat exchanger 10.

In a similar way, a further heat exchange spacer 140*b* is mounted on the upper surface of the heat exchange plate 38 such that the lower surface 58 of the heat exchanger spacer 140*b* is adjacent to the upper surface of the heat exchange plate 38. The further heat exchange spacer 140*b* is positioned on the heat exchange plate 38 such that the first side wall 60 of the unitary body 144 at the first elongate portion 150*b* is adjacent to the edge of the heat exchange plate 38 at the first end 34 of the heat exchanger 10 and the first side wall 60 of the unitary body 144 at the second elongate portion 152*b* is adjacent to the edge of the heat exchange plate 38 at the first side 30 of the heat exchanger 10.

In this way an opening 194 is defined between the first end 146*b* of the heat exchange spacer 140*b* and the second end 148*a* of the heat exchange spacer 140*a* and a further opening 196 is defined between the first end 146*a* of the heat exchange spacer 140*a* and the second end 148*b* of the heat exchange spacer 140*b*. Heat exchange plates 38 including heat exchange spacers 140*a*, 140*b* as shown in FIG. 7 may be assembled into second heat exchange layers of a heat exchanger 10 as described above.

With reference to FIG. 8, a heat exchange spacer 140*c* may be assembled on a heat exchange plate 38 such that the first side wall 60 of the unitary body 144 at the first elongate portion 150*c* is adjacent to the edge of the heat exchange plate 38 at the first end 34 of the heat exchanger 10 and the first side wall 60 of the unitary body 144 at the second elongate portion 152*c* is adjacent to the edge of the heat exchange plate 38 at the first side 32 of the heat exchanger 10.

In a similar way, a heat exchange spacer 140*d* may also be positioned on the heat exchange plate 38 such that the first side wall 60 of the unitary body 144 at the first elongate portion 150*d* is adjacent to the edge of the heat exchange plate 38 at the second end 36 of the heat exchanger 10 and the first side wall 60 of the unitary body 144 at the second elongate portion 152*d* is adjacent to the edge of the heat exchange plate 38 at the first side 30 of the heat exchanger 10.

In this way, an opening 190 is defined between the second end 148*d* of the heat exchange spacer 140*d* and the first end 146*c* of the heat exchange spacer 140*c* and a further opening 192 is defined between the second end 148*c* of the heat exchange spacer 140*c* and the first end 146*d* of the heat exchange spacer 140*d*. Heat exchange plates 38 including heat exchange spacers 140*c*, 140*d* as shown in FIG. 8 may be assembled into first heat exchange layers of a heat exchanger 10 as described above.

Referring now to FIGS. 9 to 14, there is an alternative heat exchanger 210. Features in common with the heat exchanger 10 are depicted with like reference numerals. The heat exchanger 210 is a plate and bar heat exchanger having an upper plate 12, a lower plate 14, a heat exchange core 216 and four tanks 218, 220, 222, 224. The heat exchanger 210 is generally cuboid and has a first side 230, a second side 232, a first end 234 and a second end 236. The heat exchange core 216 has a plurality of plates 238, a plurality of heat exchange spacers 240 according to a third embodiment of the disclosure a plurality of heat exchange spacers 340 according to a fourth embodiment of the disclosure and a plurality of heat exchange fins 242, 342.

Figure 12:
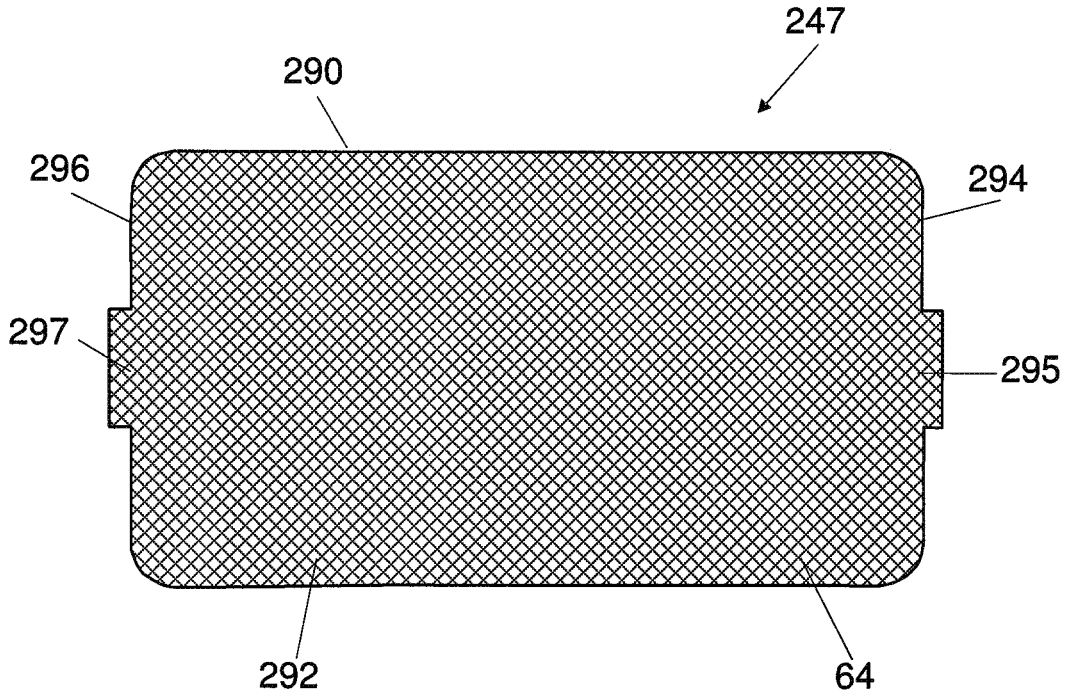
FIG. 12 is a plan view of a first fin as included in the heat exchanger of FIGS. 9 and 10.
Figure 14:
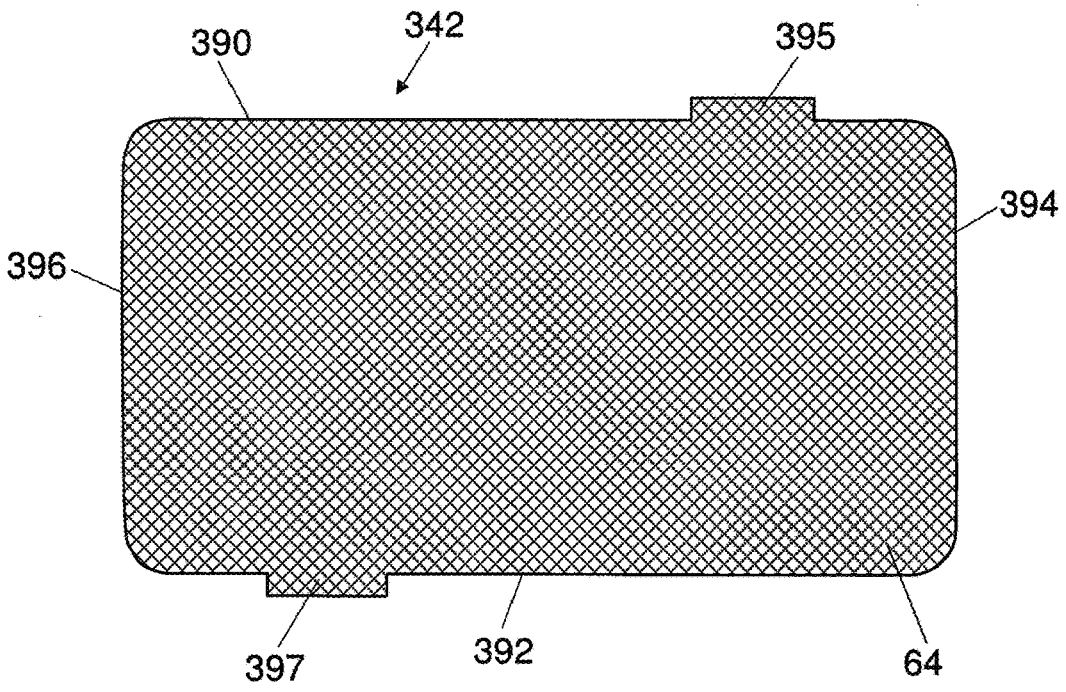
FIG. 14 is a plan view of a second fin as included in the heat exchanger of FIGS. 9 and 10.

With reference to FIGS. 12, 14 and 25, each of the heat exchange fins 242, 342 includes an undulating surface 64. The undulating surface 64 has a plurality of peaks 66 and troughs 68 that define at least one passageway 70 for the passage of a fluid (not shown). The distance between each peak 66 and its corresponding trough 68 defines the height J of heat exchange fin 242, 342.

With particular reference to FIG. 12, the heat exchange fins 242 are generally rectangular and have a first side 290, a second side 292, a third side 294 and a fourth side 296. The second side 292 is opposite the first side 290 and the third side 294 is opposite the fourth side 296. Each of the first side 290 and the second side 292 is longer than the third side 294 and the fourth side 296. The heat exchange fins 242*a*, 242*b*, 242*b* include a first tab 295 that extends outward from the third side 294 and a second tab 297 that extends outward from the fourth side 296. With particular reference to FIG. 14, the heat exchange fins 342 are generally rectangular and have a first side 390, a second side 392, a third side 394 and a fourth side 396. The second side 392 is opposite the first side 390 and the third side 394 is opposite the fourth side 396. Each of the first side 390 and the second side 392 is longer than the third side 394 and the fourth side 396. The heat exchange fins 342*a*, 342*b*, 342*c* include a first tab 395 that extends outward from the first side 390 and a second tab 397 that extends outward from the second side 392.

Figure 11:
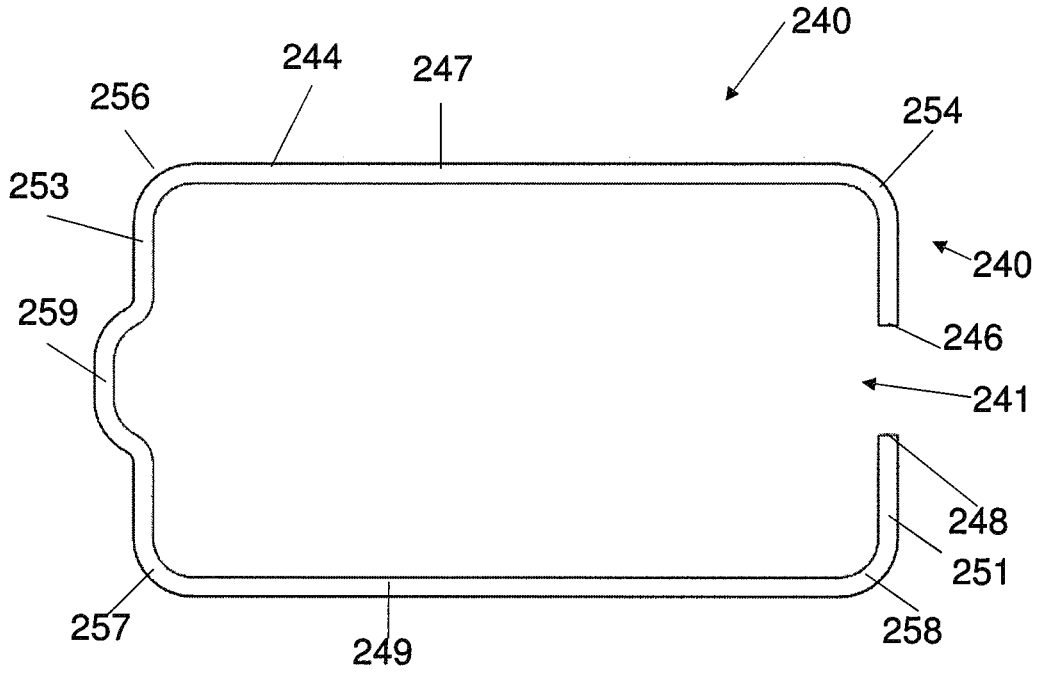
FIG. 11 is a plan view of a heat exchange spacer according to the third embodiment of the present disclosure.

As shown in FIG. 11, each of the heat exchange spacers 240 according to the third embodiment of the present disclosure has a unitary body 244. The unitary body 244 has a first end 246 and a second end 248. The unitary body 244 is generally rectangular and has a first side 247 that is opposite a second side 249 and a third side 251 that is opposite a fourth side 253.

The unitary body 244 includes a first arcuate portion or bend 254 between the first end 246 and the first side 247, a second arcuate portion or bend 256 between the first side 247 and the fourth side 253, a third arcuate portion or bend 257 between the fourth side 253 and the second side 249 and a fourth arcuate portion or bend 258 between the second side 249 and the second end 248.

The unitary body 244 includes a joggle 259 at the fourth side 253, the joggle 259 being positioned between the second arcuate portion 256 and the third arcuate portion 257. An opening 241 is defined at the third side 251 between the first end 246 and the second end 248 of the unitary body 244.

Each of the heat exchange spacers 240 has a generally rectangular cross section as shown in FIG. 4B in relation to the first embodiment of the present disclosure, with an upper surface 56, a lower surface 58 and a first side wall 60 and a second side wall 62. Each of the heat exchange spacers 240 has a length defined by the distance between the first end 246 and the second end 248 and a height H defined by the distance between the upper surface 56 and the lower surface 58. The height H of each of the heat exchange spacers 240 is substantially constant along the length of each of the heat exchange spacers 240.

Figure 13:
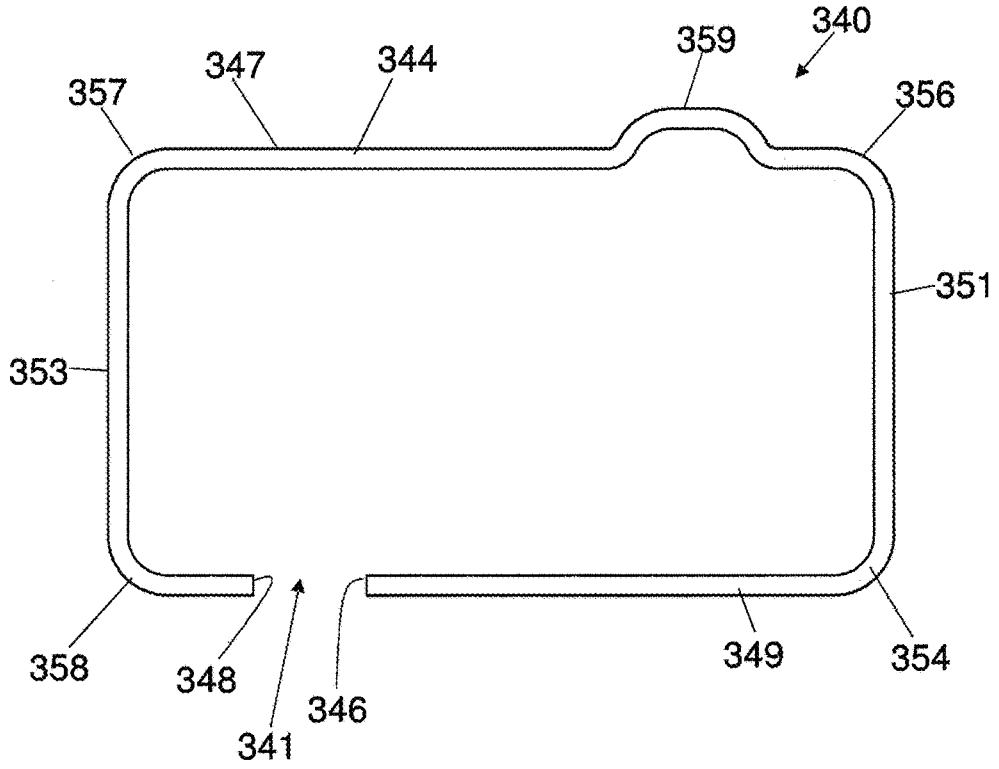
FIG. 13 is a plan view of a heat exchange spacer according to the fourth embodiment of the present disclosure.

As shown in FIG. 13, each of the heat exchange spacers 340 according to the fourth embodiment of the present disclosure has a unitary body 344. The unitary body 344 has a first end 346 and a second end 348. The unitary body 344 is generally rectangular and has a first side 347 that is opposite a second side 349 and a third side 351 that is opposite a fourth side 353.

The unitary body 344 includes a first arcuate portion or bend 354 between the first end 346 and the third side 351, a second arcuate portion or bend 356 between the third side 351 and the first side 347, a third arcuate portion or bend 357 between the first side 347 and the fourth side 353 and a fourth arcuate portion or bend 358 between the fourth side 353 and the second end 348.

The unitary body 344 includes a joggle 359 at the first side 347, the joggle 359 being positioned between the second arcuate portion 356 and the third arcuate portion 357. An opening 341 is defined at the second side 349 between the first end 346 and the second end 348 of the unitary body 344.

Each of the heat exchange spacers 340 has a generally rectangular cross section as shown in FIG. 4B in relation to the first embodiment of the present disclosure, with an upper surface 56, a lower surface 58 and a first side wall 60 and a second side wall 62. Each of the heat exchange spacers 340 has a length defined by the distance between the first end 346 and the second end 348 and a height H defined by the distance between the upper surface 56 and the lower surface 58. The height H of each of the heat exchange spacers 340 is substantially constant along the length of each of the heat exchange spacers 340.

The heat exchanger 210 is assembled in a similar way to the heat exchanger 10 as described above with the exception that the heat exchange spacers 240 are mounted relative to the heat exchange fins 242 such that the first tab 295 is positioned within the opening 241 and the second tab 297 is positioned within the space provided by the joggle 259.

Similarly, the heat exchange spacers 340 are mounted relative to the heat exchange fins 342 such that the first tab 395 is positioned within the space provided by the joggle 359 and the second tab 397 is positioned within the opening 341.

Once the heat exchanger 210 has been assembled and the heat exchange spacers 240, 340 welded or brazed in position, the first tank 218 is welded to the heat exchanger 210 at the first end 234 such that the opening (tank opening) 278 of the first tank 218 is in fluid communication with the openings 241 of the heat exchange spacers 240 and the tabs 295 of the heat exchange fins 242.

The second tank 220 is similarly welded to the heat exchanger 210 at the first side 230 such that the opening (not shown) of the second tank 220 is in fluid communication with the tabs 395 of the heat exchange fins adjacent to the joggles 359 of the heat exchange spacers 340.

The third tank 222 is similarly welded to the heat exchanger 210 at the second end 236 such that the opening (not shown) of the third tank 222 is in fluid communication with the tabs 297 of the heat exchange fins adjacent to the joggles 259 of the heat exchange spacers 240.

The fourth tank 224 is similarly welded to the heat exchanger 210 at the second side 232 such that the opening 288 of the fourth tank 224 is in fluid communication with the openings 341 of the heat exchange spacers 340 and the tabs 397 of the heat exchange fins 342.

The first tank 218 is connected to a source of cold fluid and the third tank 222 is connected to an outlet. The fourth tank 224 is connected to a source of hot fluid and the second tank 220 is connected to an outlet.

Figure 15:
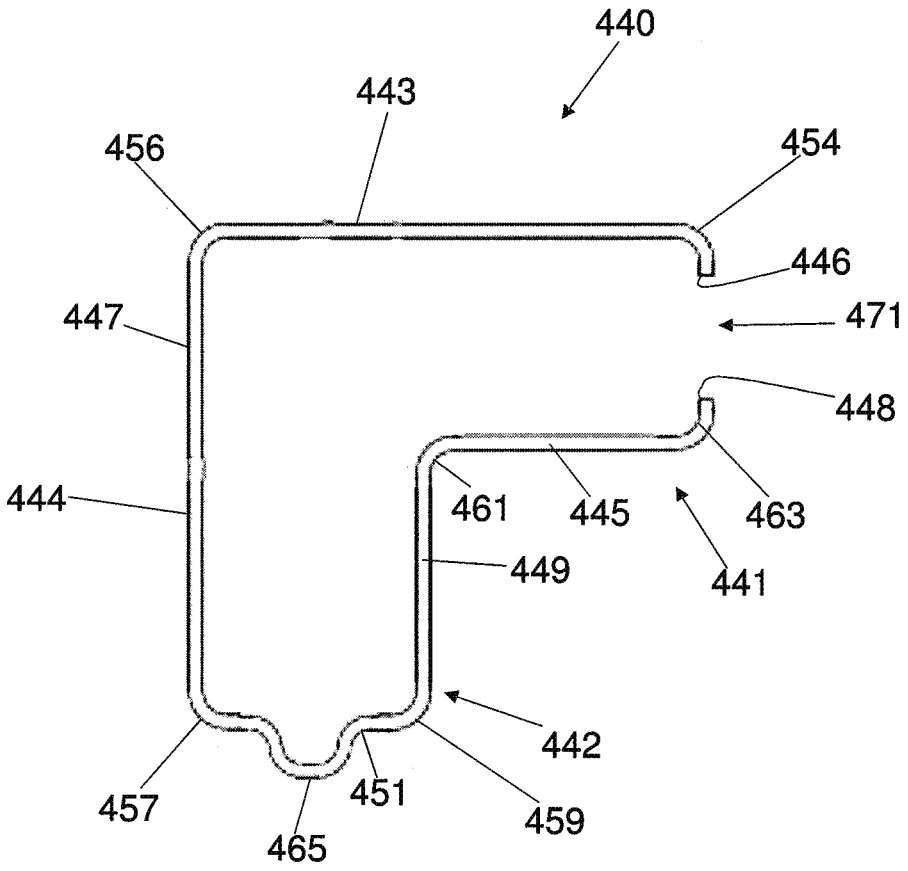
FIG. 15 is a plan view of a heat exchange spacer according to a fifth embodiment of the present disclosure.

Referring now to FIG. 15, there is a heat exchange spacer 440 according to a fifth embodiment of the disclosure. The heat exchange spacer 440 has a unitary body 444 having a first end 446 and a second end 448.

The unitary body 444 is generally L-shaped and has a first leg 441 and a second leg 442. The first leg 441 has a first elongate portion 443 and a second elongate portion 445. The first elongate portion 443 extends in a direction that is generally parallel to the second elongate portion 445. The second leg 442 has a third elongate portion 447 and a fourth elongate portion 449. The third elongate portion 447 extends in a direction that is generally parallel to the fourth elongate portion 449. The third elongate portion 447 and the fourth elongate portion 449 are separated by a lower portion 451 of the unitary body that extends in a direction that is generally perpendicular to the third elongate portion 447 and the fourth elongate portion 449.

The unitary body 444 includes a first arcuate portion or bend 454 between the first end 446 and the first elongate portion 443, a second arcuate portion or bend 456 between the first elongate portion 443 and the third elongate portion 447, a third arcuate portion or bend 457 between the third elongate portion 447 and the lower portion 451, a fourth arcuate portion or bend 459 between the lower portion 451 and the fourth elongate portion 449, a fifth arcuate portion or bend 461 between the fourth elongate portion 449 and the second elongate portion 445 and a sixth arcuate portion or bend 463 between the second elongate portion 445 and the second end 448.

The unitary body 444 includes a joggle 465 at the lower portion 451, the joggle 465 being positioned between the third arcuate portion 457 and the fourth arcuate portion 459. An opening 471 is defined between the first end 446 and the second end 448 of the unitary body 444.

The heat exchange spacer 440 has a generally rectangular cross section as shown in FIG. 4B in relation to the first embodiment of the present disclosure, with an upper surface 56, a lower surface 58 and a first side wall 60 and a second side wall 62. The heat exchange spacer 440 has a length defined by the distance between the first end 446 and the second end 448 and a height H defined by the distance between the upper surface 56 and the lower surface 58. The height H of the heat exchange spacer 440 is substantially constant along its length.

Figure 16:
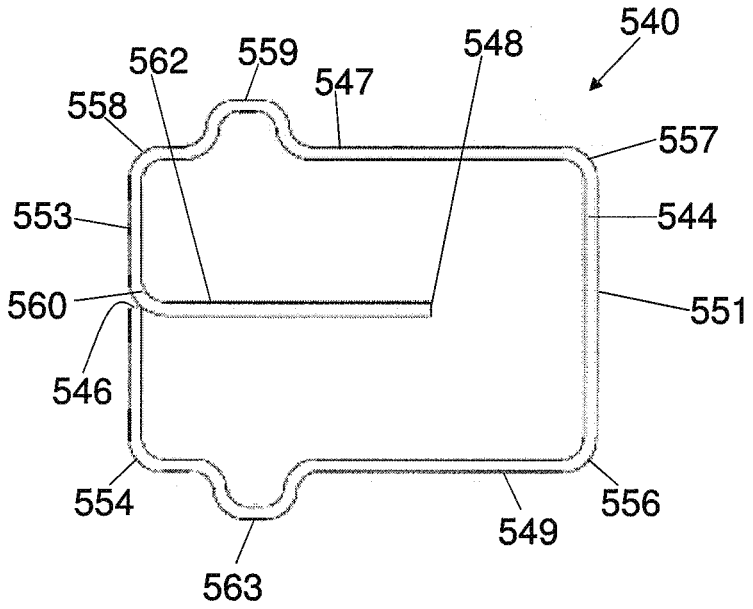
FIG. 16 is a plan view of a heat exchange spacer according to a sixth embodiment of the present disclosure.

Referring now to FIG. 16, there is a heat exchange spacer 540 according to a sixth embodiment of the present disclosure. The heat exchange spacer 540 has a unitary body 544. The unitary body 544 has a first end 546 and a second end 548. The unitary body 544 is generally rectangular and has a first side 547 that is opposite a second side 549 and a third side 551 that is opposite a fourth side 553.

The unitary body 544 includes a first arcuate portion or bend 554 between the first end 546 and the second side 549, a second arcuate portion or bend 556 between the second side 549 and the third side 551, a third arcuate portion or bend 557 between the third side 551 and the first side 547, a fourth arcuate portion or bend 558 between the first side 547 and the fourth side 553 and a fifth arcuate portion or bend 560 between the fourth side 553 and the second end 548.

A portion 562 of the unitary body 544 that extends between the fifth arcuate portion 560 and the second end 548 extends inward relative to the generally rectangular unitary body 544.

The unitary body 544 includes a first joggle 559 at the first side 547, the joggle 559 being positioned between the third arcuate portion 557 and the fourth arcuate portion 558.

The unitary body 544 includes a second joggle 563 at the second side 549, the second joggle 563 being positioned between the first arcuate portion 554 and the second arcuate portion 556.

The heat exchange spacer 540 has a generally rectangular cross section as shown in FIG. 4B in relation to the first embodiment of the present disclosure, with an upper surface 56, a lower surface 58 and a first side wall 60 and a second side wall 62. The heat exchange spacers 540 has a length defined by the distance between the first end 546 and the second end 548 and a height H defined by the distance between the upper surface 56 and the lower surface 58. The height H of the heat exchange spacer 540 is substantially constant along its length.

Figure 17:
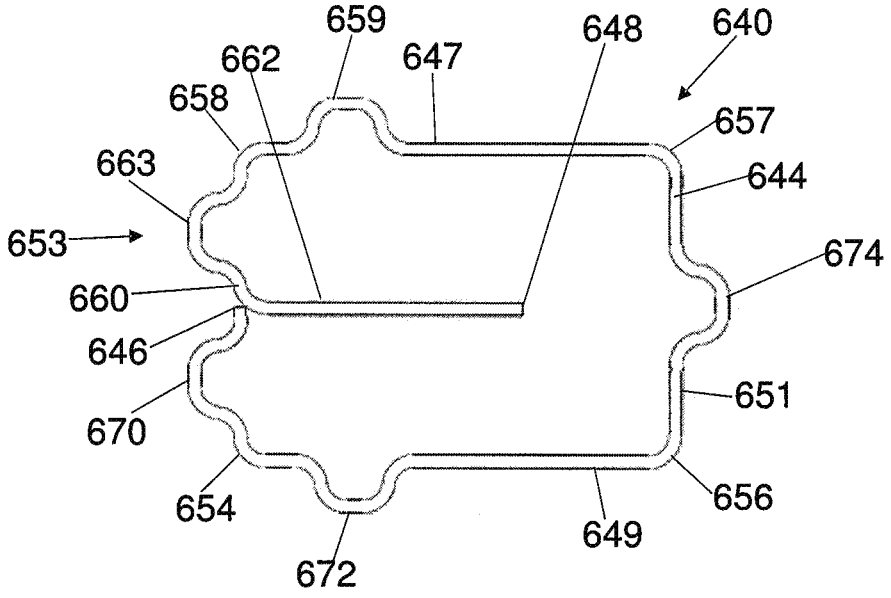
FIG. 17 is a plan view of a heat exchange spacer according to a seventh embodiment of the present disclosure.

Referring now to FIG. 17, there is a heat exchange spacer 640 according to a seventh embodiment of the present disclosure. The heat exchange spacer 640 has a unitary body 644. The unitary body 644 has a first end 646 and a second end 648. The unitary body 644 is generally rectangular and has a first side 647 that is opposite a second side 649 and a third side 651 that is opposite a fourth side 653.

The unitary body 644 includes a first arcuate portion or bend 654 between the first end 646 and the second side 649, a second arcuate portion or bend 656 between the second side 649 and the third side 651, a third arcuate portion or bend 657 between the third side 651 and the first side 547, a fourth arcuate portion or bend 658 between the first side 647 and the fourth side 653 and a fifth arcuate portion or bend 660 between the fourth side 653 and the second end 648.

A portion 662 of the unitary body 644 that extends between the fifth arcuate portion 660 and the second end 648 extends inward relative to the generally rectangular unitary body 644.

The unitary body 644 includes a first joggle 659 at the first side 647, the joggle 659 being positioned between the third arcuate portion 657 and the fourth arcuate portion 658.

The unitary body 644 includes a second joggle 663 at the fourth side 653, the second joggle 663 being positioned between the fourth arcuate portion 658 and the fifth arcuate portion 660.

The unitary body 644 includes a third joggle 670 at the fourth side 653, the third joggle 670 being positioned between the first end 646 and the first arcuate portion 654.

The unitary body 644 includes a fourth joggle 672 at the second side 649, the fourth joggle 672 being positioned between the first arcuate portion 654 and the second arcuate portion 656.

The unitary body 644 includes a fifth joggle 674 at the third side 674, the fifth joggle 674 being positioned between the second arcuate portion 656 and the third arcuate portion 657.

The heat exchange spacer 640 has a generally rectangular cross section as shown in FIG. 4B in relation to the first embodiment of the present disclosure, with an upper surface 56, a lower surface 58 and a first side wall 60 and a second side wall 62. The heat exchange spacer 640 has a length defined by the distance between the first end 646 and the second end 648 and a height H defined by the distance between the upper surface 56 and the lower surface 58. The height H of the heat exchange spacer 640 is substantially constant along its length.

Figure 18:
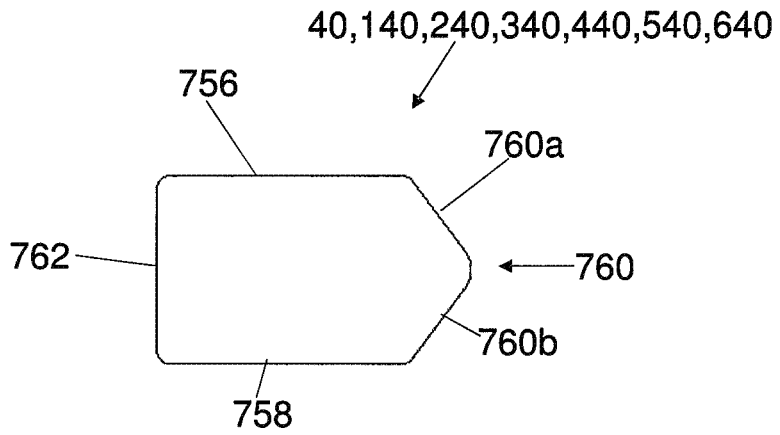
FIG. 18 is a cross section view of a heat exchange spacer according to an alternative embodiment of the present disclosure.

In any of the above embodiments of the present disclosure, the heat exchange spacer 40, 140, 240, 340, 440, 540, 640 may have a generally pentagonal cross section, for example as shown in FIG. 18. The heat exchange spacer 40, 140, 240, 340, 440, 540, 640 having an upper surface 756, a lower surface 758, a first side wall 760 including a first side wall portion 760*a* and a second side wall portion 760*b*, and a second side wall 762.

Figure 19:
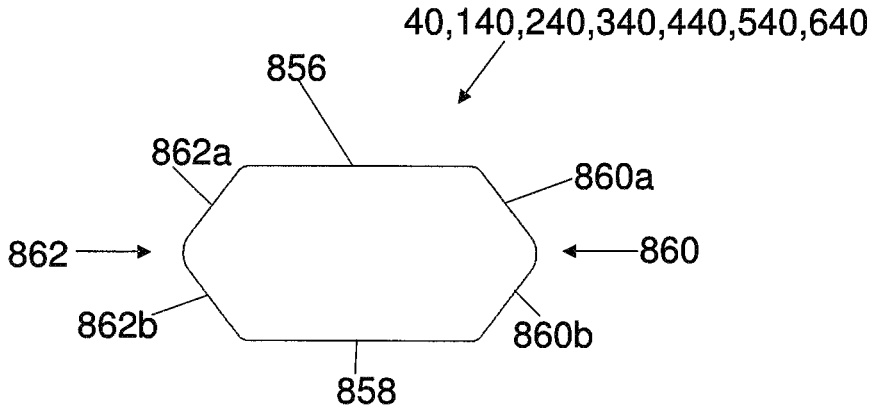
FIG. 19 is a cross section view of a heat exchange spacer according to a further alternative embodiment of the present disclosure.

As shown in FIG. 19, the heat exchange spacer 40, 140, 240, 340, 440, 540, 640 may have a generally hexagonal cross section. The heat exchange spacer 40, 140, 240, 340, 440, 540, 640 having an upper surface 856, a lower surface 858, a first side wall 860 including a first side wall portion 860*a* and a second side wall portion 860*b*, and a second side wall 862 including a third side wall portion 862*a* and a fourth side wall portion 862*b*.

Figure 20:
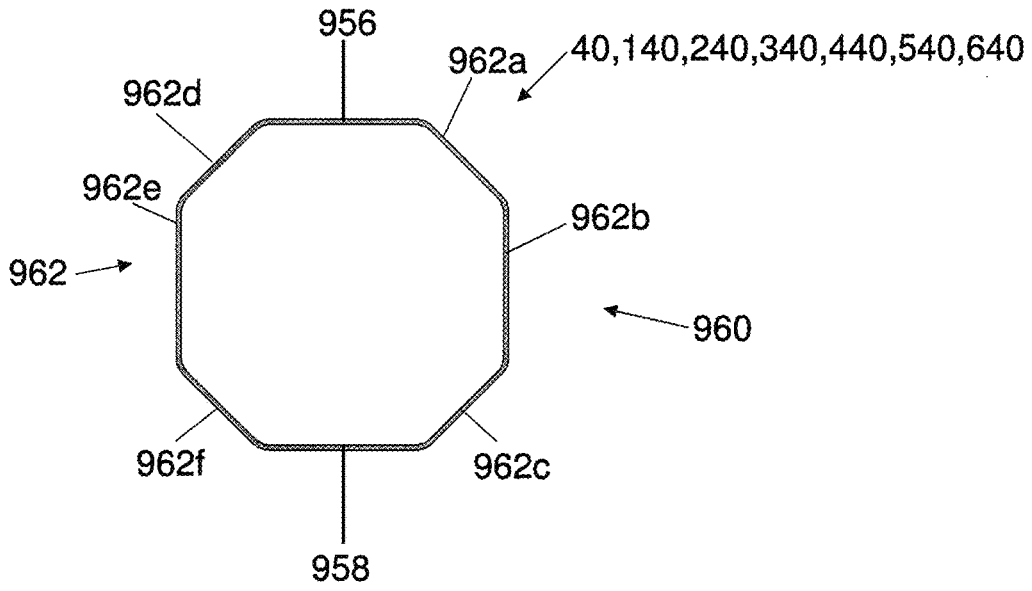
FIG. 20 is a cross section view of a heat exchange spacer according to an alternative embodiment of the present disclosure.

As shown in FIG. 20, the heat exchange spacer 40, 140, 240, 340, 440, 540, 640 may have a generally octagonal cross section. The heat exchange spacer 40, 140, 240, 340, 440, 540, 640 having an upper surface 956, a lower surface 958, a first side wall 960 including a first side wall portion 960*a*, a second side wall portion 960*b* and a third side wall portion 960*c* and a second side wall 962 including a fourth side wall portion 962*a*, a fifth side wall portion 962*b* and a sixth side sixth side wall portion 962*c*.

Figure 21:
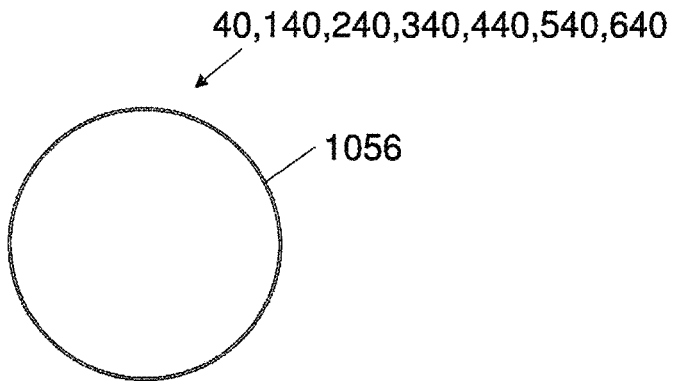
FIG. 21 is a cross section view of a heat exchange spacer according to an alternative embodiment of the present disclosure.

As shown in FIG. 21, the heat exchange spacer 40, 140, 240, 340, 440, 540, 640 may have a generally circular cross section and an outer wall 1056.

Figure 22:
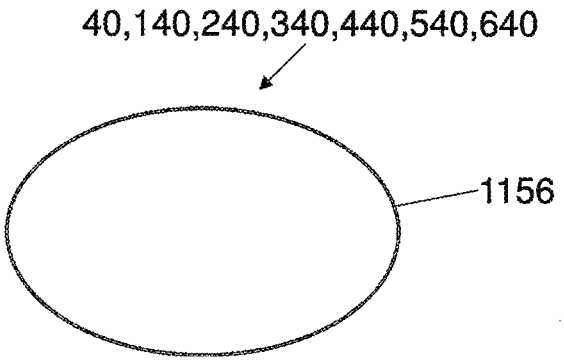
FIG. 22 is a cross section view of a heat exchange spacer according to an alternative embodiment of the present disclosure.

Alternatively, as shown in FIG. 22 the heat exchange spacer 40, 140, 240, 340, 440, 540, 640 may have a generally elliptical cross section an outer wall 1156.

Figure 23:
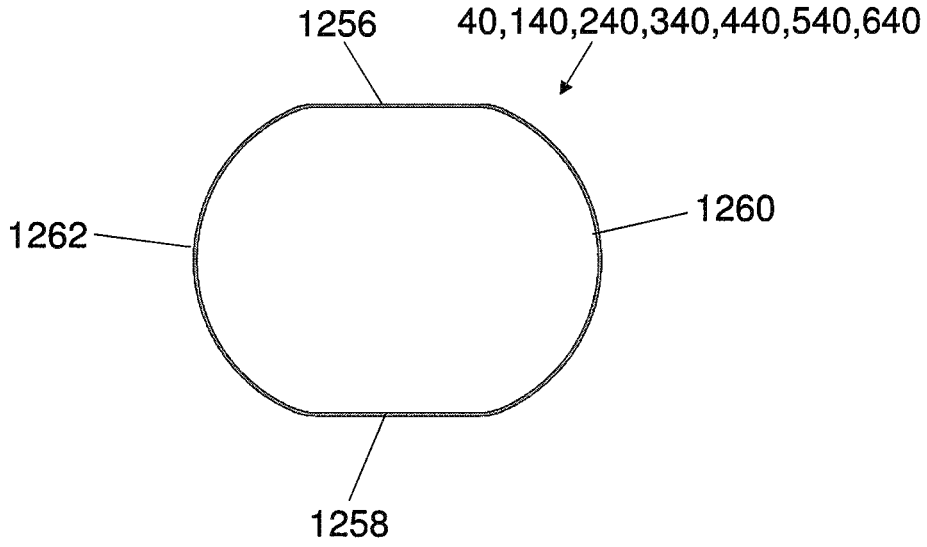
FIG. 23 is a cross section view of a heat exchange spacer according to an alternative embodiment of the present disclosure.

As shown in FIG. 23, the heat exchange spacer 40, 140, 240, 340, 440, 540, 640 may have a planar upper surface 1256, a lower planar surface 1258, a first arcuate side wall 1260 and a second arcuate or rounded wall 1262.

Figure 24:
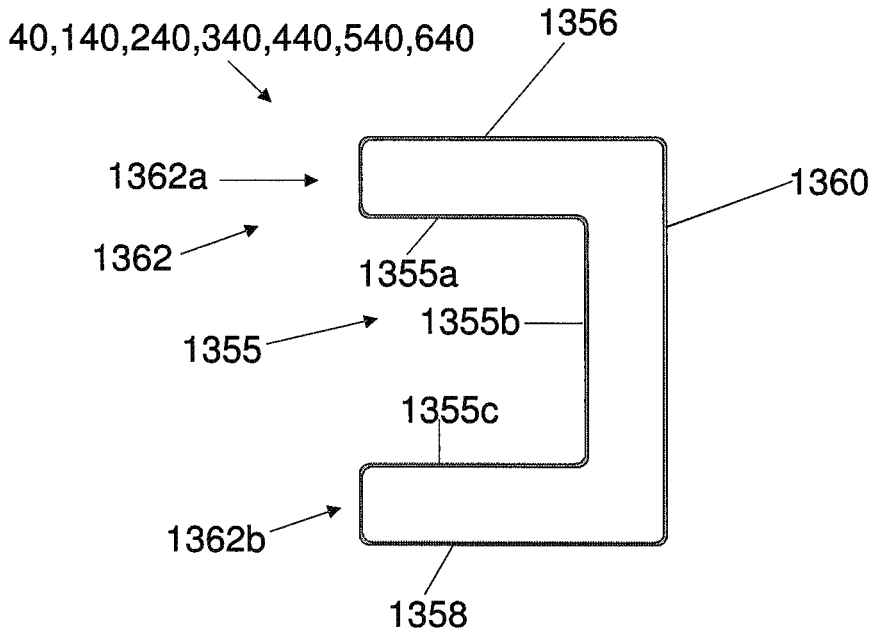
FIG. 24 is a cross section view of a heat exchange spacer according to an alternative embodiment of the present disclosure.

Alternatively, as shown in FIG. 24, the heat exchange spacer 40, 140, 240, 340, 440, 540, 640 may have a generally rectangular cross section with a channel or cut out 1355. The heat exchange spacer 40, 140, 240, 340, 440, 540, 640 may have an upper surface 1356, a lower surface 1358 a first side wall 1360 and a second side wall 1362 including a first side wall portion 1362*a* and a second side wall portion 1362*b*. The cut out may include an inner upper surface 1355*a* in a side wall surface 1355*b* and an inner lower surface 1355*c*. The cut out enables the provision of a heat exchange spacer with reduced weight.

As described above the heat exchanger 10 and the heat exchanger 210 are regular polygon prisms having a generally rectangular cross section. In alternative embodiments of the disclosure, the heat exchanger may be a regular polygon prism having a cross section that is generally pentagonal or hexagonal or ovoid. In some embodiments, the heat exchanger may be generally toroidal, for example as shown in FIGS. 26 and 27.

Figure 26:
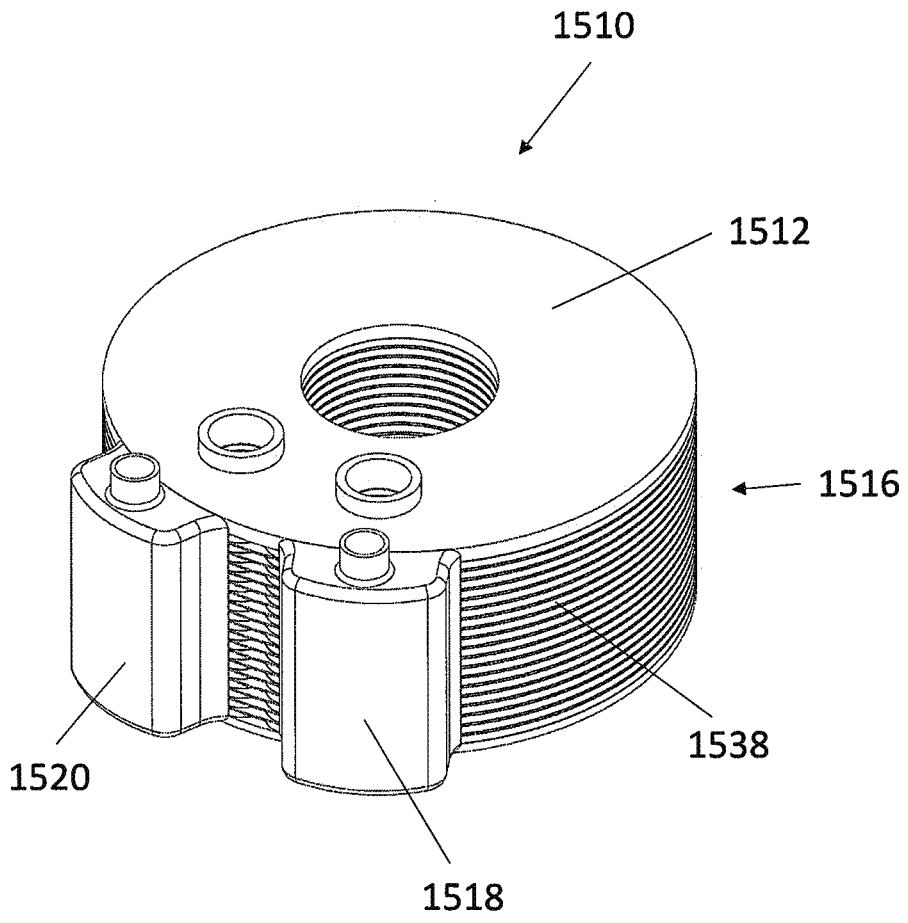
FIG. 26 is an isometric view of an alternative heat exchanger.
Figure 27:
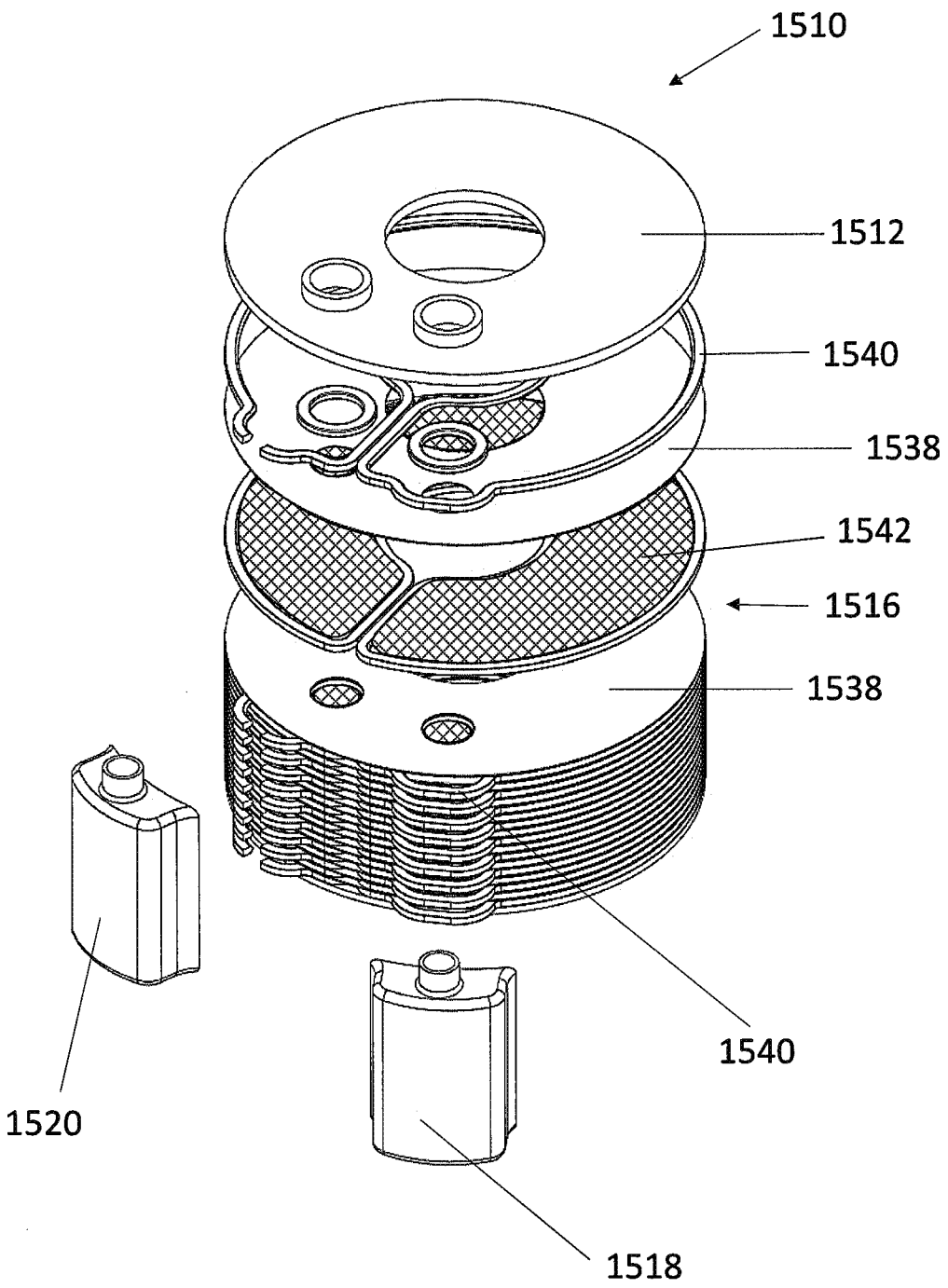
FIG. 27 is an exploded view of the heat exchanger of FIG. 26.

Referring now to FIGS. 26 and 27, the heat exchanger 1510 has an upper plate 1512, a heat exchange core 1516 and two tanks 1518, 1520. The heat exchange core 1516 has a plurality of generally circular plates 1538, a plurality of generally circular heat exchange spacers 1540 and a plurality of generally circular heat exchange fins 1542.

In alternative embodiments the heat exchanger may be a more complex or non-traditional (non-cuboid) shape as shown in FIGS. 28, 29, 30 and 31.

Figure 28:
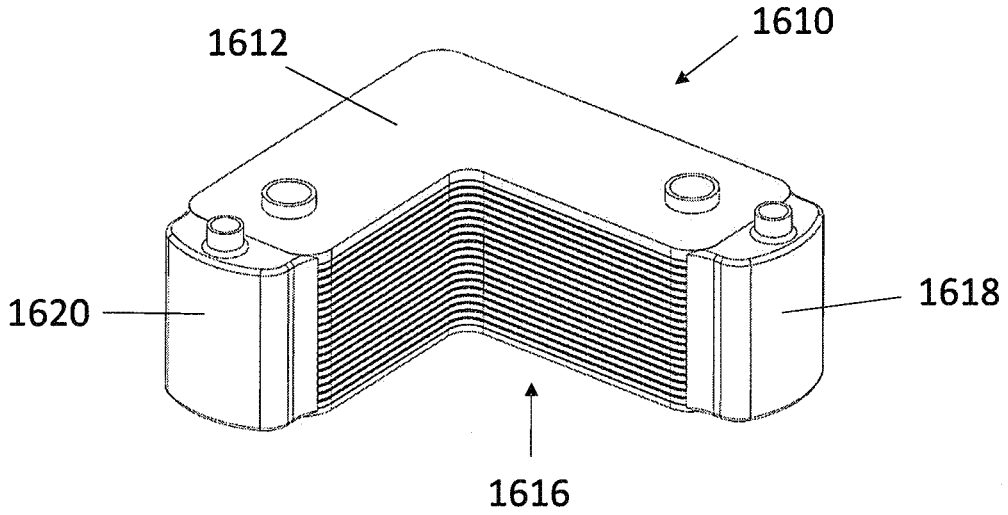
FIG. 28 is an isometric view of an alternative heat exchanger.
Figure 29:
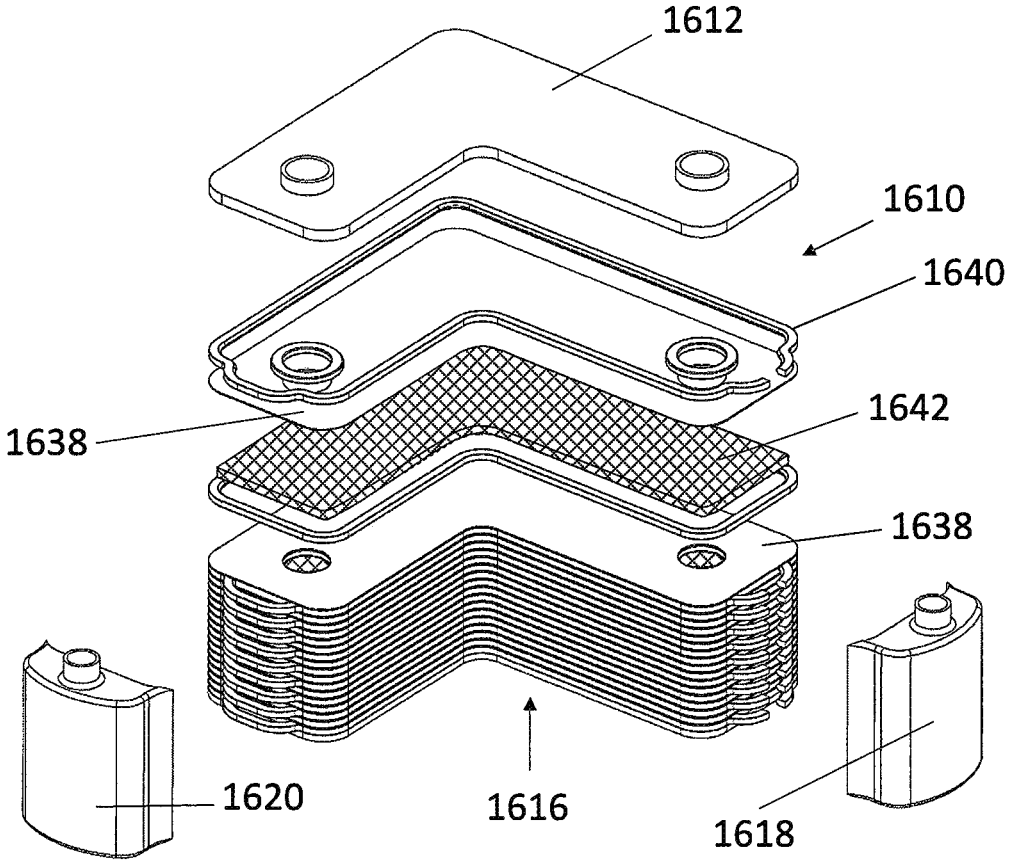
FIG. 29 is an exploded view of the heat exchanger of FIG. 28.

Referring now to FIGS. 28 and 29, the heat exchanger 1610 has an upper plate 1612, a heat exchange core 1616 and two tanks 1618, 1620. The heat exchange core 1616 has a plurality of generally L-shaped plates 1638, a plurality of generally L-shaped heat exchange spacers 1640 and a plurality of generally L-shaped heat exchange fins 1642.

Figure 30:
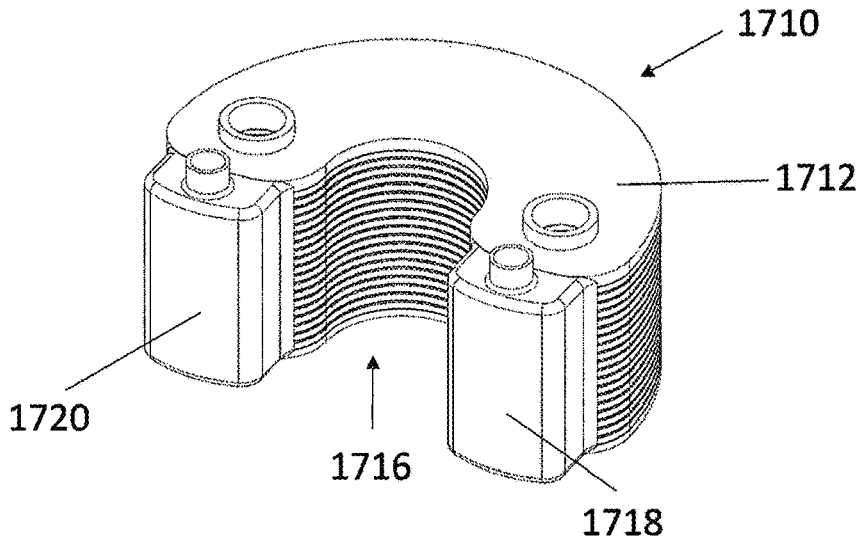
FIG. 30 is an isometric view of an alternative heat exchanger.
Figure 31:
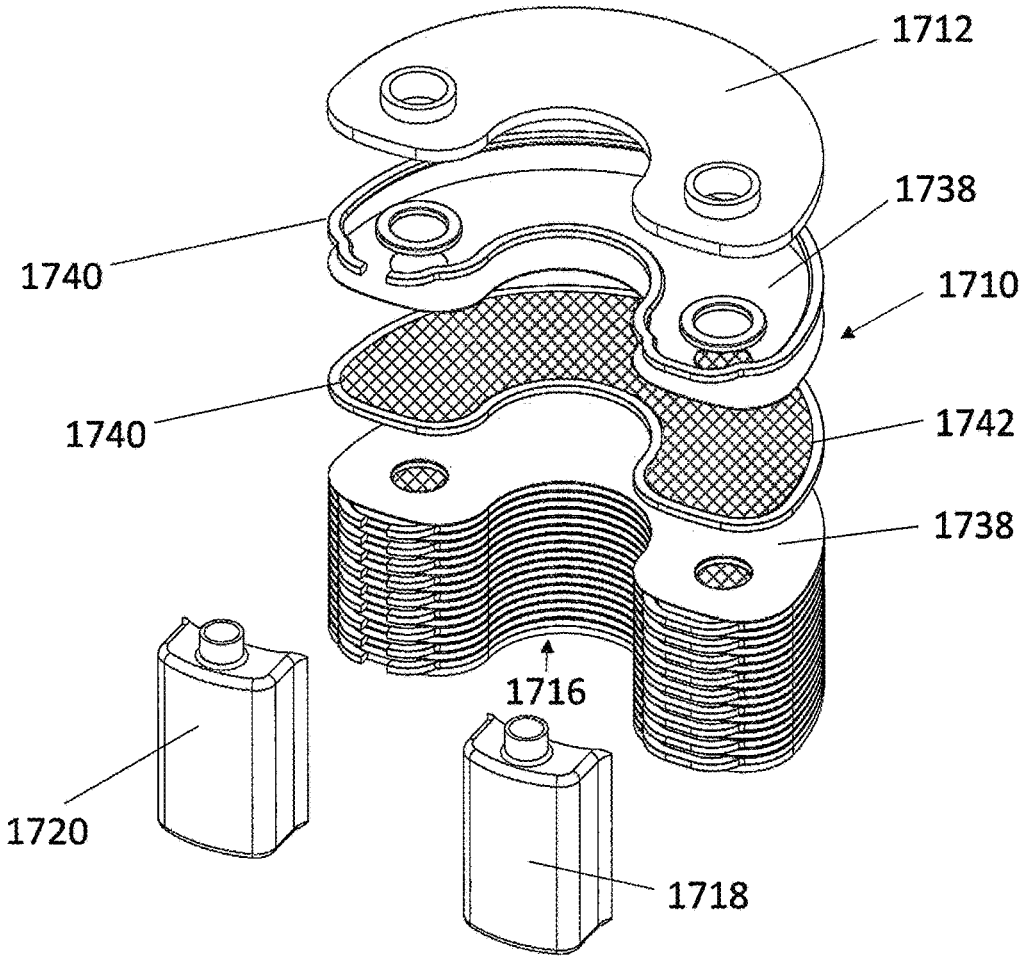
FIG. 31 is an exploded view of the heat exchanger of FIG. 30.

Referring now to FIGS. 30 and 31, there is shown a C-shaped heat exchanger 1710. The heat exchanger 1710 has an upper plate 1712, a heat exchange core 1716 and two tanks 1718, 1720. The heat exchange core 1716 has a plurality of generally C-shaped plates 1738, a plurality of generally C-shaped heat exchange spacers 1740 and a plurality of generally C-shaped heat exchange fins 1742. The C-shaped heat exchanger 1710 is particularly advantageous as the weight is reduced compared to a generally cuboid heat exchanger.

It will be understood that the heat exchangers 1510, 1610, 1710 are assembled and used as described in relation to the heat exchangers 10, 210.

The heat exchanger spacers and the heat exchange cores for heat exchangers as described herein enable the manufacture of heat exchangers for applications where a traditional generally cuboid structure may not be appropriate. A further advantage provided by the present disclosure is the ability to reduce the amount of material used in the manufacture of heat exchangers and/or to reduce the weight of heat exchangers.

According to a first aspect of the present disclosure there is provided a heat exchanger comprising:

a heat exchange core for a plate heat exchanger, the heat exchange core including a first plate, a second plate and a heat exchange layer, the heat exchange layer being positioned between the first plate and the second plate, wherein the heat exchange layer includes:

a heat exchange fin that defines at least one passageway for a fluid, at least one heat exchange spacer, the or each heat exchange spacer having a unitary body including a first elongate portion and a second elongate portion, the first elongate portion and the second elongate portion defining an angle therebetween, wherein at least one opening is defined between the ends of one body or the ends of two bodies, or is defined by at least one joggle in the or at least one body that extends outward, and at least one tank with an opening such that the opening of the or each tank is in fluid communication with the or a said heat exchange spacer opening.

The present disclosure could be particularly advantageous as it reduces the complexity of assembling heat exchangers and also reduces the risk of leaks in heat exchangers.

The body may further include at least one arcuate portion between the first elongate portion and the second elongate portion.

The body may take any suitable form and may have a polygonal cross section, such as a generally rectangular cross section. Alternatively, the body may have a generally pentagonal cross section, or a generally hexagonal cross section, or a generally ovoid cross section, and may have flat, parallel upper and lower surfaces. In that way, the cross section of the body will act to urge the fin away from the upper and lower surfaces, preventing the fin from overlapping the upper or lower surface of the body, which could create a leak path.

The body, in overall shape, may take any suitable form, and in particular embodiments may be generally L-shaped, or generally C-shaped, or generally rectangular, or cylindrical.

A further advantage of the present disclosure is that it facilitates the manufacture of heat exchangers in more complex or non-traditional (non-cuboid) shapes, or any regular or irregular polygon prism, for example cylindrical or L-shaped.

Preferably only one spacer is used in each layer.

The inclusion of an opening facilitates the fluid connection of a fluid inlet or outlet to the heat exchanger and facilitates assembly of a heat exchanger.

An opening between the ends of one body or the ends of two bodies may be on a portion of the body that is opposite to the or at least one joggle.

A generally rectangular body may have a first pair of opposing sides and a second pair of opposing sides, each of the sides of the first pair of opposing sides having a first length and each of the sides of the second pair of opposing sides having a second length, the first length being greater than the second length.

The or at least one joggle may be included on a first side of the first pair of opposing sides and the opening between spacer ends may be included on a second side of the first pair of opposing sides. Alternatively, the or at least one joggle may be included on a first side of the second pair of opposing sides and the opening between spacer ends may be included on a second side of the second pair of opposing sides.

The at least one joggle may be a first joggle and the body may include a second joggle that extends outward. The first joggle may be included on a first side of the first pair of opposing sides and the second joggle may be included on a second side of the first pair of opposing sides. Alternatively, the first joggle may be included on a first side of the second pair of opposing sides and the second joggle may be included on a second side of the second pair of opposing sides.

The body may include more than two joggles that extend outward. At least one joggle may be included on each side of the rectangular body. A plurality of joggles may be included on one or more sides of the rectangular body.

The body may further include a portion that extends inward.

The body may have a height and a length and the height of the body may be substantially constant along the length of the body. This facilitates assembly of a heat exchanger and minimises the risk of leaks within a heat exchanger.

The heat exchange layer may be a first heat exchange layer, wherein the heat exchange fin is a first heat exchange fin that defines a first at least one passageway for a first fluid and the inner plate is a first inner plate. The heat exchange core may further include a second heat exchange layer, the second heat exchange layer including a second heat exchange fin that defines at least one passageway for a second fluid, at least one heat exchange spacer in accordance with the first aspect of the disclosure and a second inner plate.

The at least one passageway that is defined by the first heat exchange fin of the first heat exchange layer may extend in a first orientation and the at least one passageway that is defined by the second heat exchange fin of the second heat exchange layer may extend in a second orientation.

The first orientation may be substantially parallel to the second orientation. Alternatively, the first orientation may be substantially perpendicular to the second orientation, or otherwise non-parallel to the second orientation.

The heat exchange core may include a plurality of first heat exchange layers and a plurality of second heat exchange layers. The plurality of first heat exchange layers and the plurality of second heat exchange layers may be arranged in an alternating stack between the first plate and the second plate.

The heat exchange core may further include a first inlet, a first outlet, a second inlet and a second outlet. The first inlet and the first outlet may be in fluid communication with the at least one passageway that is defined by the first heat exchange fin of the first heat exchange layer. The second inlet and the second outlet may be in fluid communication with the at least one passageway that is defined by the second heat exchange fin of the second heat exchange layer.

The or each heat exchange fin may have a fin height and the or each heat exchange spacer may have a spacer height, wherein the fin height and the spacer height may be substantially equal.

According to another aspect of the present disclosure there is provided a method of assembling a heat exchanger including the steps:

(a) providing a base plate;

(b) mounting at least one heat exchange spacer on the base plate;

(c) mounting a first heat exchange fin defining at least one first fluid passageway on the at least one heat exchange spacer of step (b);

(d) mounting a first inner plate on the first heat exchange fin;

(e) mounting at least one heat exchange spacer on the inner plate;

(f) mounting a second heat exchange fin defining at least one second fluid passageway on the at least one heat exchange spacer of step (e);

(g) mounting a second inner plate on the second heat exchange fin;

(h) mounting at least one heat exchange spacer on the base plate;

(i) mounting a further first heat exchange fin defining at least one first fluid passageway on the at least one heat exchange spacer of step (h);

(j) mounting an upper plate on the further first heat exchange fin; and wherein the mounting of at least one heat exchange spacer includes the steps of:

(k) providing a unitary body;

(l) shaping the unitary body to provide a first elongate portion and a second elongate portion, the first elongate portion and the second elongate portion defining an angle therebetween; and (m) finishing the shaped unitary body, wherein at least one opening is defined between the ends of one body or the ends of two bodies or is defined by at least one joggle in the or at least one body that extends outwardly, and (n) mounting at least one tank with an opening such that the opening of the tank is in fluid communication with the or a said heat exchange spacer opening.

In step (m) an outer surface of the shaped unitary body may be smoothed, or planished, or otherwise finished for example to ensure that the height of the unitary body is constant over its length. This facilitates assembly of a heat exchanger and minimises the risk of leaks within a heat exchanger.

In step (l) the unitary body may be shaped to include at least one arcuate portion between the first elongate portion and the second elongate portion.

In step (k) the unitary body may be provided to have a polygonal cross section, such as a generally rectangular cross section. Alternatively, the unitary body may be provided to have a generally pentagonal cross section, or a generally hexagonal cross section, or a generally ovoid cross section, and may have flat, parallel upper and lower surfaces, preventing the fin from overlapping the upper or lower surface, which could create a leak path.

In step (l) the unitary body may be shaped to take any suitable form, for example generally L-shaped, or generally C-shaped, or generally rectangular, or cylindrical. This facilitates the manufacture of heat exchangers in more complex or non-traditional (non-cuboid) shapes, or any regular or irregular polygon prism, for example cylindrical or L-shaped.

In step (l) the unitary body may be shaped to include at least one joggle that extends outward. The inclusion of one or more joggles provides a site for a fluid inlet or outlet and facilitates assembly of a heat exchanger.

In step (l) the unitary body may be shaped to define an opening between the ends of the body.

In step (l) the unitary body may be shaped to include a portion that extends inward.

The step of mounting may include brazing, for example, brazing the or each first heat exchange spacer to the base plate.

Before step (j), steps (d) to (i) may be repeated at least once.

After step (j), a first inlet and a first outlet may be connected in fluid communication with the at least one first fluid passageway.

After step (j), a second inlet and a second outlet may be connected in fluid communication with the at least one second fluid passageway.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A heat exchanger comprising:

a heat exchange core for a plate heat exchanger, the heat exchange core including a first plate, a second plate and a heat exchange layer that are stacked side by side along a stacking direction, the heat exchange layer being positioned between the first plate and the second plate along the stacking direction, wherein the heat exchange layer includes:

a tank through which a fluid flows, the tank having a tank opening;

a heat exchange fin that defines at least one passageway for the fluid, the at least one passageway being in fluid communication with the tank; and a heat exchange spacer consisting of a single elongated member and extending continuously from one end of the single elongated member to another end of the single elongated member, the heat exchange spacer having a shape fitting to the heat exchange fin, the heat exchange spacer has:

an opening that is defined between the one end and the other end and that is in fluid communication with the tank opening; and a joggle that faces the opening along a planar direction perpendicular to the stacking direction and protrudes outward and away from the opening along the planar direction, and the heat exchange fin has a tab that extends outward along the planar direction and that is positioned within the opening of the heat exchange spacer.

2. The heat exchanger according to claim 1, wherein the heat exchange spacer of the heat exchange spacer includes at least one arcuate portion.

3. The heat exchanger according to claim 1, wherein the heat exchange spacer of the heat exchange spacer has a generally rectangular cross section.

4. The heat exchanger according to claim 1, wherein the unitary body of the heat exchange spacer has a generally pentagonal cross section.

5. The heat exchanger according to claim 1, wherein the unitary body of the heat exchange spacer has a generally hexagonal cross section.

6. The heat exchanger according to claim 1, wherein the unitary body of the heat exchange spacer has a generally ovoid cross section.

7. The heat exchanger according to claim 1, wherein the unitary body of the heat exchange spacer is generally L-shaped.

8. The heat exchanger according to claim 1, wherein the unitary body of the heat exchange spacer is generally C-shaped.

9. The heat exchanger according to claim 1, wherein the heat exchange spacer is generally rectangular.

10. The heat exchanger according to claim 9, wherein the heat exchange spacer has:

a first side and a second side facing each other; and a third side and a fourth side facing each other with the first and second sides interposed between the third side and the fourth side, each of the first side and the second side has a first length and each of the third side and the fourth side has a second length, the first length is longer than the second length, the joggle is formed in one of the third and fourth sides, and the opening is formed in another of the third and fourth sides.

11. The heat exchanger according to claim 1, wherein a height of the heat exchange spacer is substantially constant along a length of the heat exchange spacer.

* * * * *